US012473930B2

(12) United States Patent
Zhu

(10) Patent No.: US 12,473,930 B2
(45) Date of Patent: Nov. 18, 2025

(54) CONNECTION MEMBER OF NECK FAN AND NECK FAN

(71) Applicant: Guangdong Aoyun Technology Co., Ltd., Guangdong (CN)

(72) Inventor: Xueping Zhu, Guangdong (CN)

(73) Assignee: Guangdong Aoyun Technology Co., Ltd., Huizhou (CN)

( * ) Notice: Subject to any disclaimer, the term of this patent is extended or adjusted under 35 U.S.C. 154(b) by 0 days.

(21) Appl. No.: 18/972,473

(22) Filed: Dec. 6, 2024

(65) Prior Publication Data

US 2025/0237231 A1 Jul. 24, 2025

Related U.S. Application Data

(63) Continuation-in-part of application No. 18/933,625, filed on Oct. 31, 2024, and a continuation-in-part of application No. 18/421,213, filed on Jan. 24, 2024, now Pat. No. 12,281,656.

(51) Int. Cl.

| | |
|---|---|
| ***F04D 29/52*** | (2006.01) |
| ***F04D 19/00*** | (2006.01) |
| ***F04D 25/06*** | (2006.01) |
| ***F04D 25/16*** | (2006.01) |

(52) U.S. Cl.
CPC ..... *F04D 29/522* (2013.01); *F04D 19/002* (2013.01); *F04D 25/0673* (2013.01); *F04D 25/166* (2013.01)

(58) Field of Classification Search
CPC .. F04D 29/522; F04D 19/002; F04D 25/0673; F04D 25/166
See application file for complete search history.

(56) References Cited

U.S. PATENT DOCUMENTS 11,703,060 B1 * 7/2023 Song ..... F04D 25/166 415/60
2021/0355960 A1 * 11/2021 Liu ..... F04D 25/0673

* cited by examiner

*Primary Examiner* — Sabbir Hasan
(74) *Attorney, Agent, or Firm* — Zhigang Ma

(57) ABSTRACT

A connection member of a neck fan configured to connect to a first fan portion and a second fan portion arranged opposite each other, the connection member includes a flexible connection portion. The flexible connection portion is provided with at least one installation hole. The at least one installation hole is configured to extend along an extending direction from a first connection end of the first fan portion to a second connection end of the second fan portion. The at least one installation hole is further configured to be sleeved and fixed onto the first connection end and the second connection end, so that the first fan portion and the second fan portion are connected through the flexible connection portion.

19 Claims, 16 Drawing Sheets

CONNECTION MEMBER OF NECK FAN AND NECK FAN

CROSS-REFERENCE TO RELATED APPLICATIONS

This application is a Continuation-in-Part of the U.S. application Ser. No. 18/933,625 filed on Oct. 31, 2024, and entitled "NECK FAN,", the entire disclosures of which are incorporated herein by reference.

The U.S. application Ser. No. 18/933,625 is a Continuation-in-Part of the U.S. application Ser. No. 18/421,213 filed on Jan. 24, 2024, and entitled "NECK FAN,", the entire disclosures of which are incorporated herein by reference.

TECHNICAL FIELD

The present invention relates to the field of fans, and in particular, to a connection member of a neck fan and a neck fan.

BACKGROUND

As portable cooling equipment, a portable fan has received widespread attentions and been widely applied in hot seasons in recent years, especially a neck fan. The neck fan can be carried around and free the hands, and are favored by the majority of users.

However, as people continue to pursue comfortable experiences, they have gradually increasing expectations for the performance of the neck fan. In the scorching summer, users hope to achieve a faster and more direct cooling effect in a high-temperature environment, but the design of the traditional neck fan fails to fully meet this demand.

For this purpose, the present invention provides a neck fan that allows air from the fan to be blown more directly and centrally towards a user, thereby providing a more comfortable user experience in a hot environment. According to this design, the cooling effect of the neck fan is improved while the portability is achieved, so that the growing demand of the user for personalized and efficient cooling equipment is met.

SUMMARY

In order to overcome the shortcomings of the prior art, the present invention provides a connection member of a neck fan and a neck fan which is convenient for the user to carry and allows air from the fan to be blown more directly and centrally towards a user, thereby providing a more comfortable user experience in a hot environment. The technical solution adopted by the present invention to solve the technical problem is as follows.

The present invention provides a connection member of a neck fan, configured to connect to a first fan portion and a second fan portion arranged opposite each other, wherein the connection member includes a flexible connection portion, the flexible connection portion is provided with at least one installation hole, the at least one installation hole is configured to extend along an extending direction from a first connection end of the first fan portion to a second connection end of the second fan portion, and the at least one installation hole is further configured to be sleeved and fixed onto the first connection end and the second connection end, so that the first fan portion and the second fan portion are connected through the flexible connection portion.

In one embodiment, the at least one installation hole is an installation through hole arranged along the extending direction, and each of two ends of the installation hole is respectively configured to sleeve and fix the first connection end and the second connection end.

In one embodiment, an inner sidewall of the at least one installation hole is provided with a first anti-detachment structure and a second anti-detachment structure, the first anti-detachment structure is configured to be snap-fitted and connected to a first buckle on an outer surface of the first connection end, the second anti-detachment structure is configured to be snap-fitted and connected to a second buckle on an outer surface of the second connection end, and at least one of the first anti-detachment structure and the first buckle includes a plurality of convex-concave structures arranged in sequence along the extending direction.

In one embodiment, the first anti-detachment structure includes a plurality of first buckle slots arranged along the extending direction, the first buckle slot is configured to be meshed and connected to a plurality of projections arranged along the extending direction on the first buckle, the second anti-detachment structure includes a plurality of second buckle slots arranged along the extending direction, the second buckle slot is configured to be meshed and connected to a plurality of projections arranged along the extending direction on the second buckle, the first anti-detachment structure is configured to be detachably connected to the first buckle, and the second anti-detachment structure is configured to be detachably connected to the second buckle.

In one embodiment, the flexible connection portion is in an arc-shaped and provided with an inner side adjacent to a human neck and an outer side away from the human neck, the first anti-detachment structure is arranged on an inner sidewall of one side of the at least one installation hole adjacent to the outer side, and the second anti-detachment structure is arranged on an inner sidewall of the other side of the at least one installation hole adjacent to the outer side.

In one embodiment, the flexible connection portion is provided with a first fixing structure and a second fixing structure, the first fixing structure and the second fixing structure are respectively arranged on each of two ends of the flexible connection portion, the first fixing structure is configured to connect to a third fixing structure of the first connection end, the second fixing structure is configured to connect to a fourth fixing structure of the second connection end, the first fixing structure is configured to detachably connect to the third fixing structure, and the second fixing structure is configured to detachably connect to the fourth fixing structure.

In one embodiment, one of the first fixing structure and the third fixing structure is a first fixing post, one of the first fixing structure and the third fixing structure is a first fixing hole, one of the second fixing structure and the fourth fixing structure is a second fixing post, one of the second fixing structure and the fourth fixing structure is a second fixing hole, the first fixing structure extends along a direction of a first tangent line perpendicular to the extending direction, and the second fixing structure extends along a direction of a second tangent line perpendicular to the extending direction.

In one embodiment, the first fixing post includes a first post body and a first buckle hook portion connected to one end of the first post body away from the flexible connection portion, and an outer diameter of the first buckle hook portion is greater than an outer diameter of the first post body to prevent the first fixing post from detaching from the first fixing hole; the second fixing post includes a second post body and a second buckle hook portion connected to one end of the second post body away from the flexible connection portion, and an outer diameter of the second buckle hook portion is greater than an outer diameter of the second post body to prevent the second fixing post from detaching from the second fixing hole.

In one embodiment, the first fixing hole includes a first portion corresponding to the first post body and a second portion corresponding to the first buckle hook portion, and a hole diameter of the second portion is greater than a hole diameter of the first portion; the second fixing hole includes a third portion corresponding to the second post body and a fourth portion corresponding to the second buckle hook portion, and a hole diameter of the fourth portion is greater than a hole diameter of the third portion.

In one embodiment, the connection member includes at least one neck support, the at least one neck support is connected to the inner side of the flexible connection portion adjacent to the human neck, and the at least one neck support is configured to form at least one air inlet gap with the first fan portion or the second fan portion, so that air of the first fan portion or the second fan portion can enter the air inlet gap.

In one embodiment, the at least one neck support includes a first neck support portion and a second neck support portion, the first neck support portion is positioned adjacent to the first fan portion and is configured to form a first air inlet gap with the first fan portion, and the second neck support portion is positioned adjacent to the second fan portion and is configured to form a second air inlet gap with the second fan portion.

In one embodiment, a plurality of projections are arranged on a surface of the at least one neck support away from the flexible connection portion, and the plurality of projections are configured to form a gap between the at least one neck support and the human neck skin.

In one embodiment, the surface of the at least one neck support away from the flexible connection portion is an arc-shaped.

In one embodiment, a size of the plurality of projections gradually decreases from a middle to two ends along a vertical direction perpendicular to the extending direction.

In one embodiment, the flexible connection portion and the at least one neck support are made of a flexible material.

In one embodiment, the flexible connection portion and the at least one neck support are made of the same flexible material and are integrally formed, and the flexible connection portion and the at least one neck support are made of a flexible silica gel material.

In one embodiment, the flexible connection member is configured to be detachably connected to at least one of the first connection end and the second connection end.

In one embodiment, the flexible connection portion includes a main body portion, a first extending portion and a second extending portion, the main body portion is provided with the at least one installation hole, the first extending portion and the second extending portion are respectively connected to each of two ends of the main body portion, the first extending portion and the second extending portion protrude from the main body portion along the extending direction, the first extending portion and the second extending portion are respectively configured to cover and connect to an inner surface of the first connection end adjacent to the human neck and an inner surface of the second connection end adjacent to the human neck.

The present invention further provides a neck fan, wherein the neck fan includes a connection member as described in any of the above embodiments, a first fan portion and a second fan portion, the connection member includes an inner end portion configured to contact with a human neck; the first fan portion and the second fan portion respectively include a fan assembly and a straight-tube-shaped fan shell covered an outer side of the fan assembly, the fan shell is positioned a lower end portion of a hanging main body, the fan shell is provided with an air inlet and an air outlet, and the fan assembly is configured to drive an air flow to be blown directly from the air inlet towards the inner end portion via the air outlet.

In one embodiment, the first fan portion and the second fan portion are provided with a first air guide path that is inwards sunken on one side adjacent to the human neck, the first air guide path extends from the first air outlet to the inner end portion, and the fan assembly drives the air flow to be blown out from the first air outlet towards the inner end portion along the first air guide path.

Beneficial effects: The present invention provides a connection member of a neck fan. The connection member of a neck fan includes a flexible connection portion. The first fan portion and the second fan portion are connected through the flexible connection portion, so that a flexible connection is formed between the first fan portion and the second fan portion, thereby facilitating the wearing by users.

Furthermore, due to the straight-tube shape of the fan assembly, the neck fan forms a vertical blowing type fan capable of blowing air in a vertical direction. The fan assembly can drive the air flow to be blown from the air inlet to the inner end portion through the first air outlet, greatly improving the air blowing efficiency. A user can directly feel the cool air blown directly to the neck when using the neck fan. This improves the overall performance of the fan.

BRIEF DESCRIPTION OF THE DRAWINGS

In order to explain the technical solutions of the embodiments of the present invention more clearly, the following will briefly introduce the accompanying drawings used in the embodiments. The drawings in the following description are only some embodiments of the present invention. Those of ordinary skill in the art can obtain other drawings based on these drawings without creative work.

The present invention is further described below in detail in combination with the accompanying drawings and embodiments.

DETAILED DESCRIPTION OF THE EMBODIMENTS

Embodiment I

Figure 1:
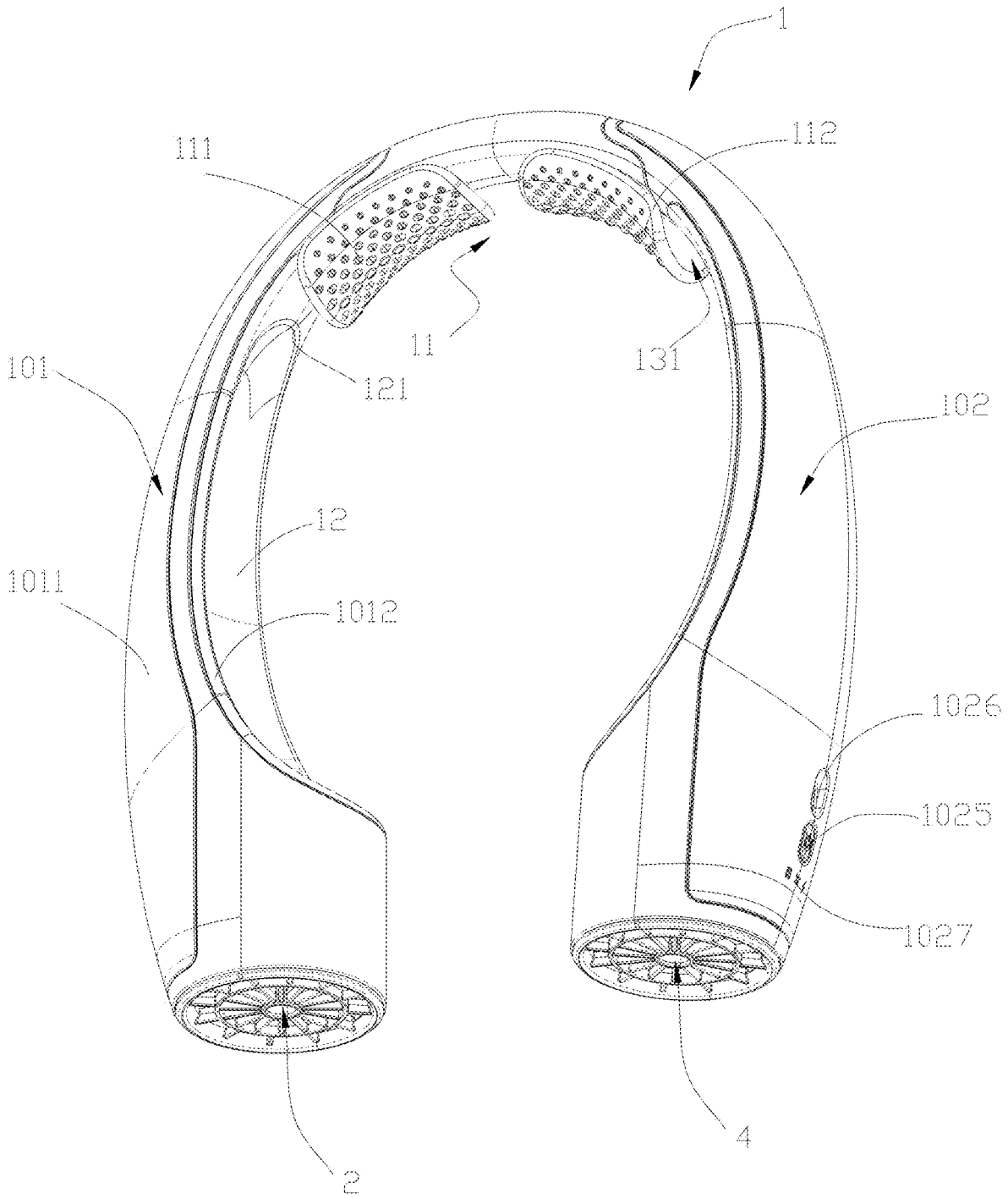
FIG. 1 is a schematic diagram of an entire structure of a neck fan according to Embodiment I of the present invention.
Figure 2:
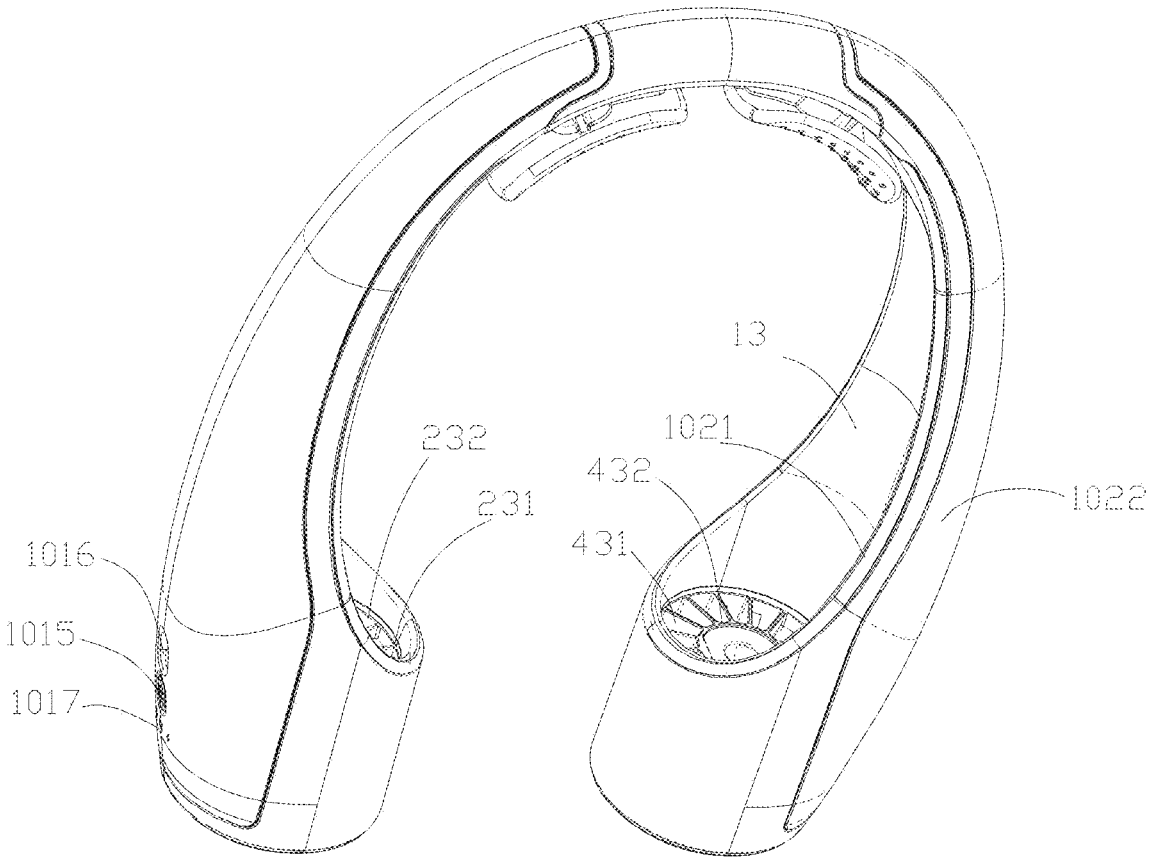
FIG. 2 is a schematic diagram of an entire structure of another viewing angle of the neck fan according to Embodiment I of the present invention.
Figure 3:
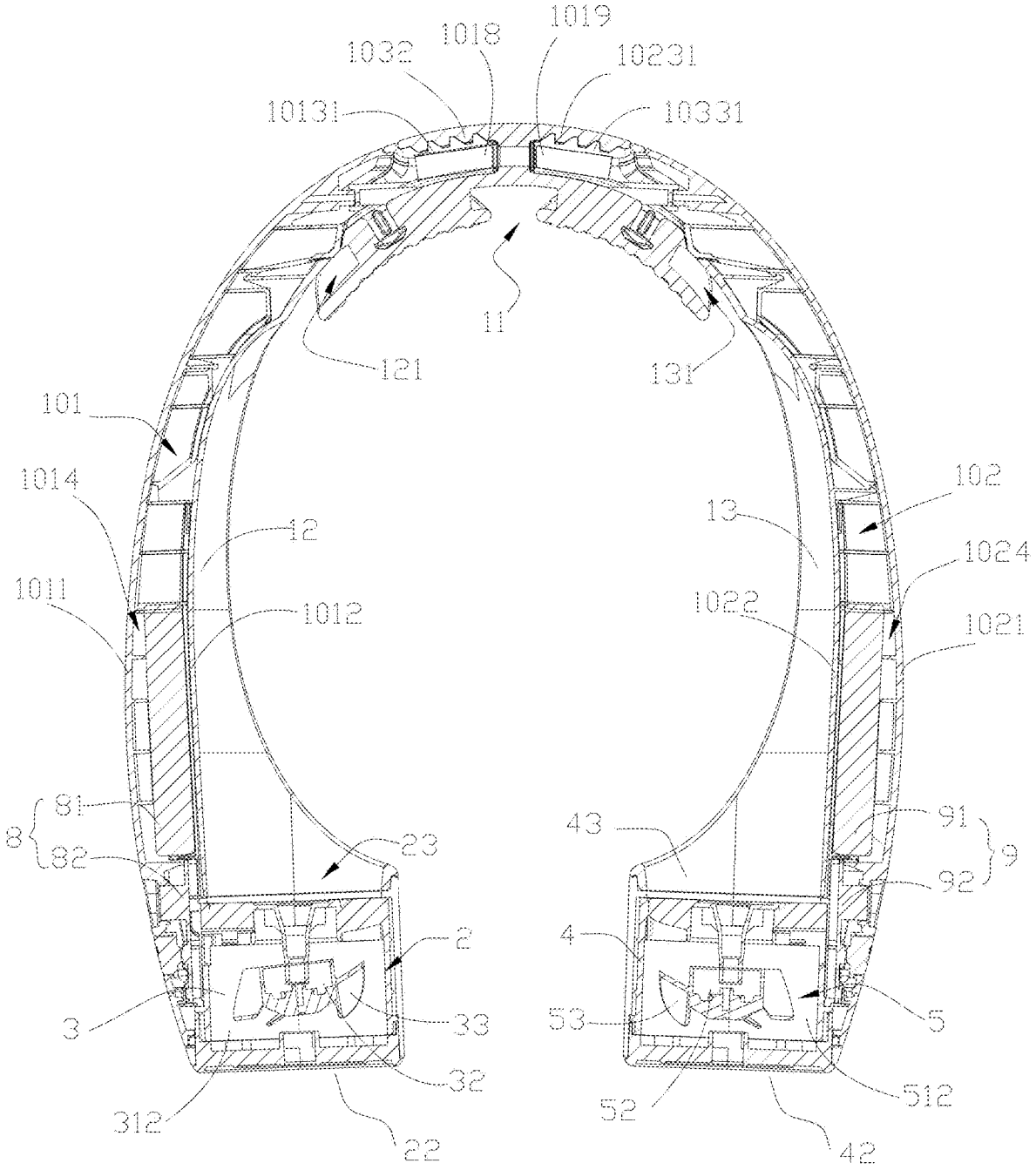
FIG. 3 is a sectional view of the neck fan according to Embodiment I of the present invention.
Figure 4:
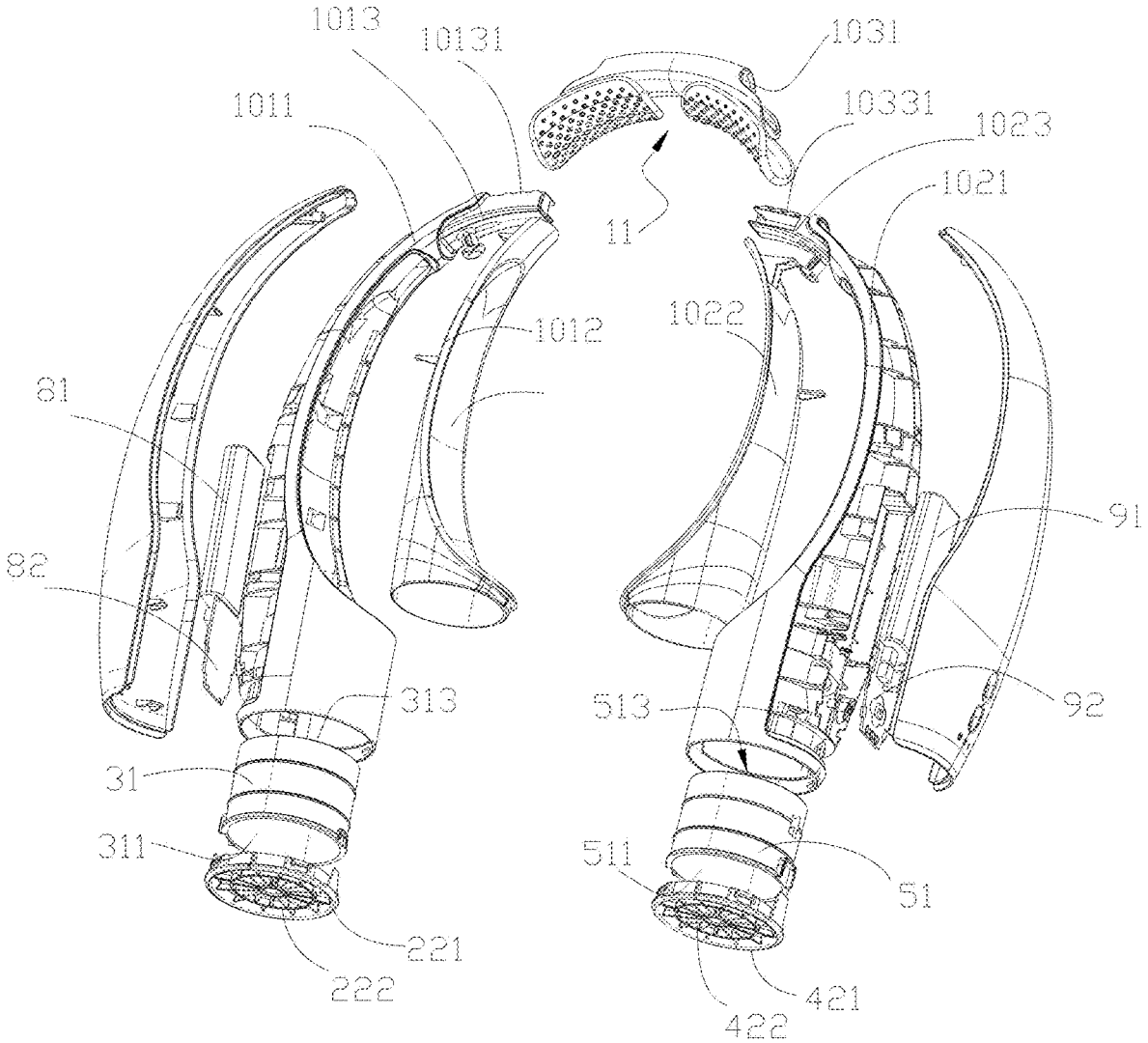
FIG. 4 is an exploded view of the neck fan according to Embodiment I of the present invention.
Figure 5:
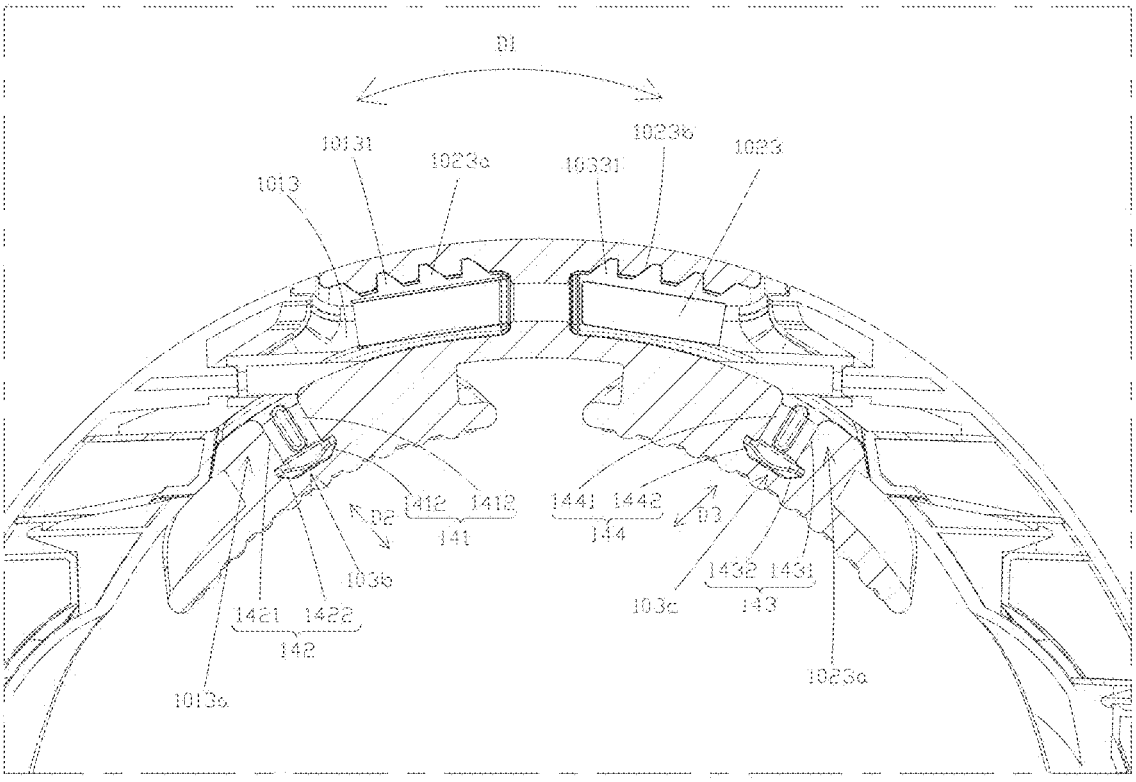
FIG. 5 is a partial enlarged structural diagram of a portion V of FIG. 3.
Figure 6:
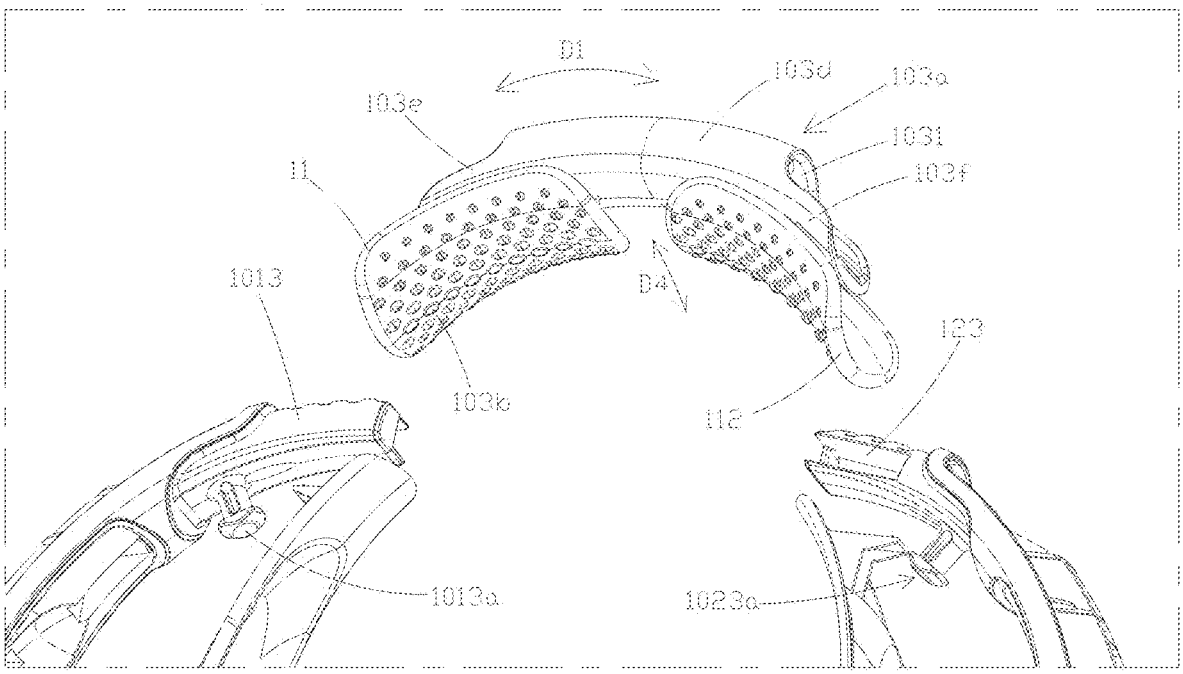
FIG. 6 is a partial enlarged structural diagram of a portion VI of FIG. 4.
Figure 7:
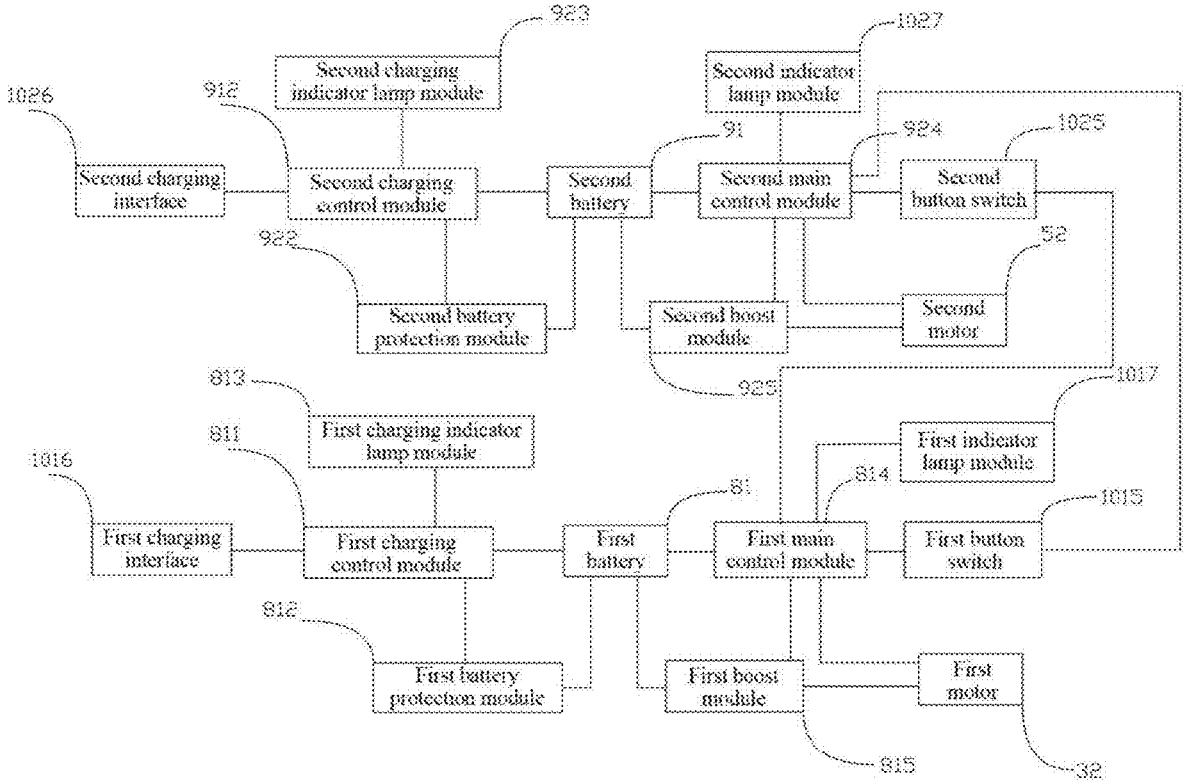
FIG. 7 is a schematic block diagram of the neck fan according to Embodiment I of the present invention.
Figure 8:
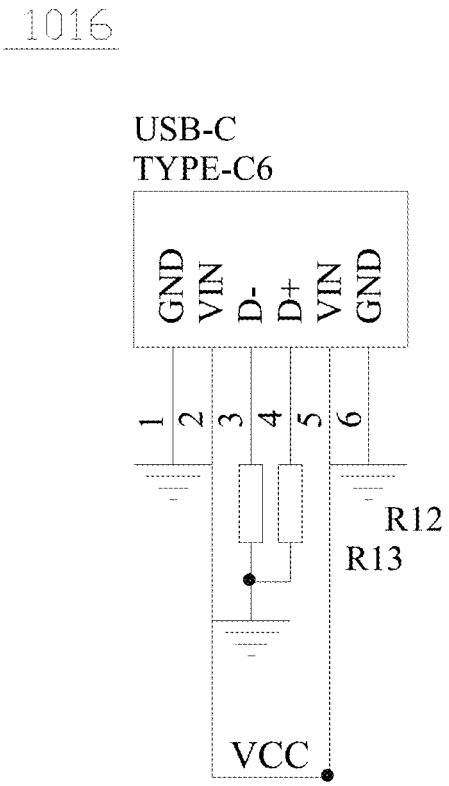
FIG. 8 is a circuit diagram of a first charging interface of the neck fan of the present invention.
Figure 9:
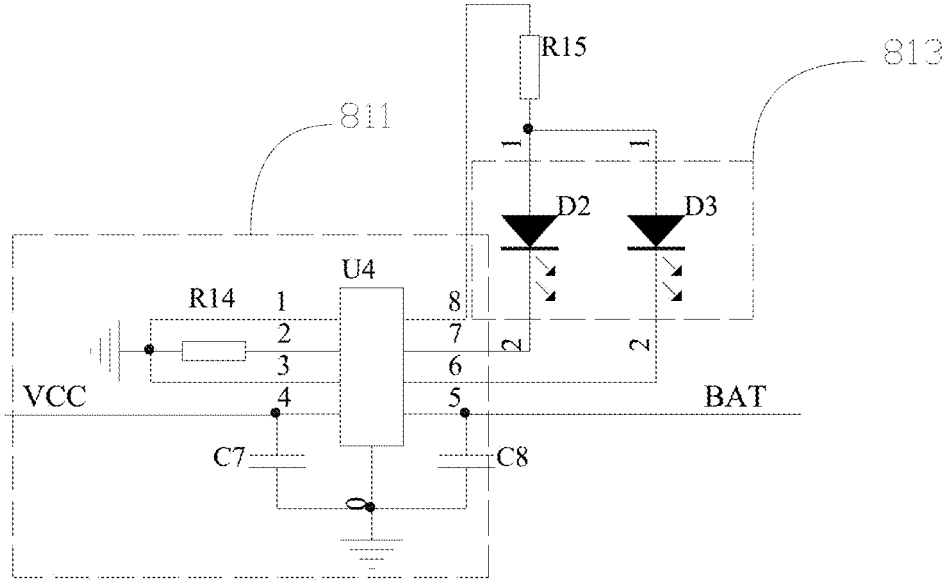
FIG. 9 is a circuit diagram of a first charging control module of the neck fan of the present invention.
Figure 10:
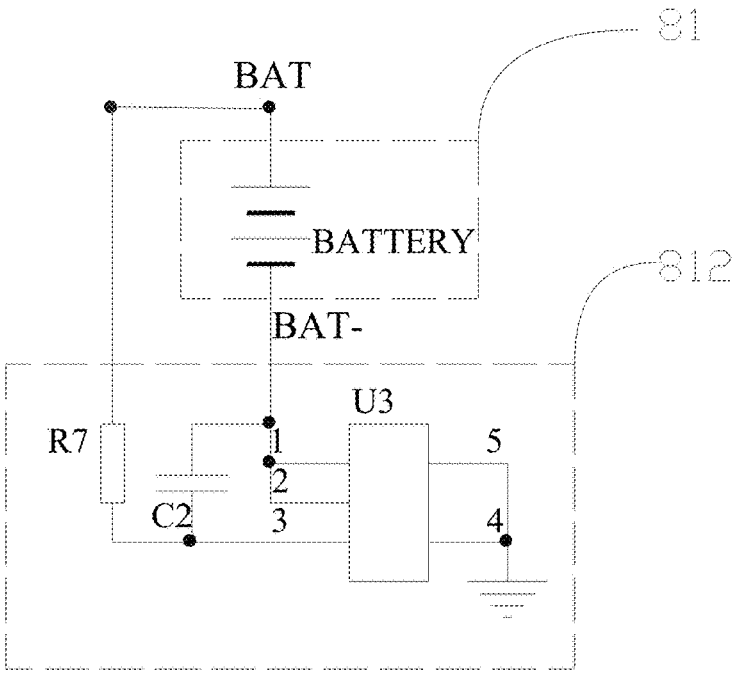
FIG. 10 is a circuit diagram of a first battery of the neck fan of the present invention.

Referring to FIG. 1 to FIG. 13, a neck fan includes a hanging main body 1. A straight-tube-shaped first air guide chamber 2 is arranged at a lower end portion of the hanging main body 1 in a protruding manner; the first air guide chamber 2 includes a first air inlet 22 arranged at the lower end portion of the hanging main body 1 and a first air outlet 23 opposite to the first air inlet 22; the hanging main body 1 includes an inner end portion 11 that is in contact with the neck of a user; the first air outlet 23 faces the inner end portion 11; and a first fan assembly 3, wherein the first fan assembly 3 is located in the first air guide chamber 2; and the first fan assembly 3 is configured to drive an air flow to flow from the first air inlet 22 to the inner end portion 11 via the first air outlet 23. Through the above structure, due to the straight-tube shape of the first air guide chamber 2, the neck fan forms a vertical blowing type fan capable of blowing air in a vertical direction. The first fan assembly 3 can drive the air flow to be blown from the first air inlet 22 to the inner end portion 11 through the first air outlet 23, greatly improving the air blowing efficiency. A user can directly feel the cool air blown directly to the neck when using the neck fan. This improves the overall performance of the fan. Furthermore, since the first air guide chamber 2 is a straight-tube-shaped cavity integrally protruding out of the hanging main body 1, this design improves the overall sense of beauty and sense of design of the product, helps to improve the wearing comfort of the neck fan, and improves the overall quality and user experience of the product.

In this embodiment, the neck fan is provided with a first air guide path 12 that is inwards sunken; the first air guide path 12 extends from the first air outlet 23 to the inner end portion 11; and the first fan assembly 3 drives the air flow to be blown out from the first air outlet 23 towards the inner end portion 11 along the first air guide path 12. Further, a flexible first neck support 111 is connected to the inner end portion 11; a first air inlet gap 121 is formed between the first neck support 111 and the inner end portion 11; the first fan assembly 3 drives the air flow to be blown out from the first air outlet 23 towards the first air inlet gap 121 along the first air guide path 12. The first neck support 111 can be a silica gel neck support, a plastic neck support, a rubber neck support, or the like. Through the above structure, when the air flow is blown out from the first air outlet 23, under the guidance of the first air guide path 12 that is inwards sunken, the air flow will be blown towards the inner end portion 11 along the first air guide path 12. Due to the first air inlet gap 121, the air flow can be blocked in the gap, so that when a user wears the neck fan, the user can have a stronger feeling about the air flow at the inner end portion 11, and the heat dissipation effect is enhanced; and furthermore, the flexible neck support provides a more comfortable supporting effect for the user, which improves the user experience.

In this embodiment, a width of the first air guide path gradually decreases towards the inner end portion along the first air outlet; a width range of the first air guide path is 1 to 5 cm; a length range of the first air guide path is 8 to 16 cm; and a depth range of the first air guide path is 0 to 3 cm.

In this embodiment, the hanging main body 1 is a U-shaped hanging main body 1; the hanging main body 1 includes a first fan portion 101, a second fan portion 102, and a connector 103; the first fan portion 101 is detachably connected to the second fan portion 102 through the connector 103; and the connector is a flexible connector 103. Specifically, the connector 103 can be a silica gel connector, a plastic connector, a rubber connector, or the like.

In this embodiment, the first fan portion 101 a first outer shell 1011 and a first inner shell 1012; the first air guide path 12 is arranged on the first inner shell 1012; and the first inner shell 1012 is detachably connected to the first outer shell 1011 through a buckle. It is convenient for a user to open and mount the first fan portion 101 for maintenance.

In this embodiment, a diameter of the first air inlet 22 is within a range of 30 mm to 60 mm, and a diameter of the first air outlet 23 is within a range of 30 mm to 60 mm. Through the above structure, an appropriate diameter range helps to achieve a balanced air flowrate, so that the fan can provide a sufficient air flow and maintain a good cooling effect. Furthermore, it helps to rationalize the overall structure, and the neck fan is convenient to carry and use.

In this embodiment, a straight-tube-shaped second air guide chamber 4 is further arranged at a lower end portion of the neck fan in a protruding manner; the second air guide chamber 4 includes a second air inlet 42 arranged at the lower end portion of the hanging main body 1 and a second air outlet 43 opposite to the second air inlet 42; the second air outlet 43 faces the inner end portion 11; a second fan assembly 5 is arranged in the second air guide chamber 4; and the second fan assembly 5 is configured to drive the air flow to be blown out from the second air inlet 42 towards the inner end portion 11 via the second air outlet 43. Through the above structure, due to the straight-tube shape of the second air guide chamber 4, the neck fan forms a vertical blowing type fan capable of blowing air in a vertical direction, so that the second fan assembly 5 can drive the air flow to be blown from the second air inlet 42 to the inner end portion 11 through the second air outlet 43, greatly improving the air blowing efficiency. A user can directly feel the cool air when using the neck fan. This improves the overall performance of the fan. Furthermore, since the second air guide chamber 4 is a straight-tube-shaped cavity integrally protruding out of the hanging main body 1, this design improves the overall sense of beauty and sense of design of the product, helps to improve the wearing comfort of the neck fan, and improves the overall quality and user experience of the product.

In this embodiment, the neck fan is provided with a second air guide path 13 that is inwards sunken; the second air guide path 13 extends from the second air outlet 43 to the inner end portion 11; and the second fan assembly 5 drives the air flow to be blown out from the second air outlet 43 towards the inner end portion 11 along the second air guide path 13. Further, a flexible second neck support 112 is connected to the inner end portion 11; a second air inlet gap 131 is formed between the second neck support 112 and the inner end portion 11; the second fan assembly 5 drives the air flow to be blown out from the second air outlet 43 towards the second air inlet gap 131 along the second air guide path 13. The second neck support 112 can be a silica gel neck support, a plastic neck support, a rubber neck support, or the like. Through the above structure, when the air flow is blown out from the second air outlet 43, under the guidance of the second air guide path 13 that is inwards sunken, the air flow will be blown towards the inner end portion 11 along the second air guide path 13. Due to the second air inlet gap 131, the air flow can be blocked in the gap, so that when a user wears the neck fan, the user can have a stronger feeling about the air flow at the inner end portion 11 more strongly, and the heat dissipation effect is enhanced; and furthermore, the flexible neck support provides a more comfortable supporting effect for the user, which improves the user experience.

In this embodiment, the second fan portion 102 includes a second outer shell 1021 and a second inner shell 1022; the second air guide path 13 is arranged on the second inner shell 1022; and the second inner shell 1022 is detachably connected to the second outer shell 1021 through a buckle. It is convenient for a user to open and mount the second fan portion 102 for maintenance.

In this embodiment, the neck fan further includes a first power supply assembly 8; the first power supply assembly 8 is located inside the hanging main body 1; the first power supply assembly 8 is electrically connected to the first fan assembly 3 to supply power to the first fan assembly 3; the first power supply assembly 8 includes a first battery 81 and a first circuit board 82; and the first battery 81 is electrically connected to the first circuit board 82 to supply power to the first circuit board 82. The neck fan further includes a second power supply assembly 9; the second power supply assembly 9 is located inside the hanging main body 1; the second power supply assembly 9 is electrically connected to the second fan assembly 5 to provide power to the second fan assembly 5; the second power supply assembly 9 includes a second battery 91 and a second circuit board 92; and the second battery 91 is electrically connected to the second circuit board 92 to supply power to the second circuit board 92. Through the above structure, the first power supply assembly 8 is arranged inside the hanging main body 1. This design can improve the overall appearance of the neck fan and effectively supply power to the first fan assembly 3, to ensure the reliability of the product. The second power supply assembly 9 is arranged inside the hanging main body 1. This design can improve the overall appearance of the neck fan and effectively supply power to the second fan assembly 5, to ensure the reliability of the product.

In this embodiment, the first fan assembly 3 includes a first fan shell 31, a first motor 32 fixedly mounted inside the first fan shell 31, and a first fan blade 33 mounted on a rotating shaft of the first motor 32; the first fan shell 31 is provided with a third air inlet 311, a first air duct 312, and a third air outlet 313; and the first air inlet 22, the third air inlet 311, the first air duct 312, the third air outlet 313, the first air guide chamber 2, and the first air outlet 23 are connected to each other in sequence. Through the above structural design, the first fan assembly 3 in this embodiment is provided with the independent outer shell, which facilitates independent mounting and replacement of the fan.

In another implementation, the first fan assembly 3 includes a first motor 32 and a first fan blade 33 mounted on a rotating shaft of the first motor 32; the first air inlet 22 is connected with a first air inlet hood 221; the first air inlet hood 221 is provided with several first air inlet holes 222; the first air outlet 23 is connected to a first air outlet hood 231; and the first air outlet hood 231 is provided with several first air outlet holes 232. Through the above structure, the design of a fan shell is omitted in this case, which saves the cost. Furthermore, a direction of the air flow is effectively achieved. The design of the first air inlet hood 221 and the first air outlet hood 231 is conducive to preventing other debris, such as hairs and paper scraps, from being sucked into the fan, which is conducive to maintaining the safety of the fan.

In this embodiment, the second fan assembly 5 includes a second fan shell 51, a second motor 52 fixedly mounted inside the second fan shell 51, and a second fan blade 53 mounted on a rotating shaft of the second motor 52; the second fan shell 51 is provided with a fourth air inlet 511, a second air duct 512, and a fourth air outlet 513; and the second air inlet 42, the fourth air inlet 511, the second air duct 512, the fourth air outlet 513, the second air guide chamber 4, and the first air outlet 23 are connected to each other in sequence. Through the above structural design, the first fan assembly 3 in this embodiment is provided with the independent outer shell, which facilitates independent mounting and replacement of the fan.

In some other embodiments, the second fan assembly 5 includes a second motor 52 and a second fan blade 53 mounted on a rotating shaft of the second motor 52; the second air inlet 42 and a fourth air inlet 511 are connected with a second air inlet hood 421; the second air inlet hood 421 is provided with several second air inlet holes 422; the second air outlet 43 and a fourth air outlet 513 are connected with a second air outlet hood 431; and the second air outlet hood 431 is provided with several second air outlet holes 432. Through the above structure, the design of a fan shell is omitted in this case, which saves the cost. Furthermore, a direction of the air flow is effectively achieved. The design of the second air inlet hood 421 and the second air outlet hood 431 is conducive to preventing other debris, such as hairs and paper scraps, from being sucked into the fan, which is conducive to maintaining the safety of the fan.

In this embodiment, the connector 103 is provided with a installation hole 1031; the first fan portion 101 is provided with a first connection end 1013 connected to the connector 103; the first connection end 1013 is detachably inserted into one end of the installation hole 1031; the second fan portion 102 is provided with a second connection end 1023 connected to the connector 103; and the second connection end 1023 is detachably inserted into the other end of the installation hole 1031.

Further, a concave-convex first buckle 10131 is arranged at the first connection end 1013; the connector 103 is provided with a first buckle slot 1032 that cooperates with the first buckle 10131; a concave-convex second buckle 10331 is arranged at the second connection end 1023; and the connector 103 is provided with a second buckle slot

10231 that cooperates with the second buckle 10331. Through the above structure, the connector 103 is a flexible silica gel connector. After the connector 103 is bent to an angle, the first fan portion 101 and the second fan portion 102 can be easily inserted into the installation hole 1031. The first fan portion 101 is in clamping fit with the first buckle slot 1032 on an inner wall of the connector 103 through the concave-convex first buckle 10131 arranged at the first connection end 1013, and the second fan portion 102 is in clamping fit with the second buckle slot 10231 on the inner wall of the connector 103 through the concave-convex second buckle 10331 arranged at the second connection end 1023, so that it is convenient to mount and connect the first fan portion 101 to the second fan portion 102 to form a complete neck fan.

Referring to FIG. 3 to FIG. 6, the connection member 103 can be divided into a flexible connection portion 103*a*, and the flexible connection portion 103*a* can be provided with at least one installation hole 1031. The at least one installation hole 1031 is configured to extend along an extending direction D1 from the first connection end 1013 of the first fan portion 101 to the second connection end 1023 of the second fan portion 102, and the at least one installation hole 1031 is further configured to be sleeved and fixed onto the first connection end 1013 and the second connection end 1023, so that the first fan portion 101 and the second fan portion 102 are connected through the flexible connection portion 103*a*. The first fan portion 101 and the second fan portion 102 are connected through the flexible connection portion 103*a*, so that a flexible connection is formed between the first fan portion 101 and the second fan portion 102, thereby facilitating the wearing by users.

In this embodiment, the flexible connection portion 103*a* is provided with a through installation through hole which is arranged along the extending direction D1, each of two ends of the installation hole 1031 is respectively configured to sleeve and fix the first connection end 1013 and the second connection end 1023. Adopting one installation through hole is simple in process and offers flexible assembly space. However, in an alternative embodiment, the flexible connection portion 103*a* may also have two blind holes (i.e., non-through holes) which are arranged oppositely. The two blind holes are respectively configured to sleeve and fix the first connection end 1013 and the second connection end 1023.

In an embodiment, an inner sidewall of the at least one installation hole 1031 is provided with a first anti-detachment structure (such as a first buckle slot) and a second anti-detachment structure (such as a second buckle slot), the first anti-detachment structure is configured to be snap-fitted and connected to the first buckle 10131 on an outer surface of the first connection end 1013, the second anti-detachment structure is configured to be snap-fitted and connected to the second buckle 10331 on an outer surface of the second connection end 1023, and at least one of the first anti-detachment structure and the first buckle 10131 includes a plurality of convex-concave structures arranged in sequence along the extending direction D1.

Specifically, in this embodiment, the first anti-detachment structure includes a plurality of first buckle slots 10231*a* arranged along the extending direction, and the first buckle slot 10231*a* is configured to be meshed and connected to a plurality of projections arranged along the extending direction on the first buckle 10131; the second anti-detachment structure includes a plurality of second buckle slots 10231*b* arranged along the extending direction, and the second buckle slot 10231*b* is configured to be meshed and connected to a plurality of projections arranged along the extending direction on the second buckle 10331; the first anti-detachment structure is configured to be detachably connected to the first buckle 10131, and the second anti-detachment structure is configured to be detachably connected to the second buckle 10331.

In an embodiment, the flexible connection portion 103*a* is in an arc-shaped and provided with an inner side adjacent to a human neck and an outer side away from the human neck, the first anti-detachment structure is arranged on an inner sidewall of one side of the at least one installation hole 1031 adjacent to the outer side, and the second anti-detachment structure is arranged on an inner sidewall of the other side of the at least one installation hole 1031 adjacent to the outer side.

In an embodiment, the flexible connection portion 103*a* is provided with a first fixing structure 103*b* and a second fixing structure 103*c*, the first fixing structure 103*b* and the second fixing structure 103*c* are respectively arranged on each of two ends of the flexible connection portion 103*a*, the first fixing structure 103*b* is configured to connect to a third fixing structure 1013*a* of the first connection end 1013, the second fixing structure 103*c* is configured to connect to a fourth fixing structure 1023*a* of the second connection end 1023; the first fixing structure 103*b* is configured to detachably connect to the third fixing structure 1013*a*, and the second fixing structure 103*c* is configured to detachably connect to the fourth fixing structure 1023*a*.

In an embodiment, one of the first fixing structure 103*b* and the third fixing structure 1013*a* is a first fixing post 141, one of the first fixing structure 103*b* and the third fixing structure 1013*a* is a first fixing hole 142; one of the second fixing structure 103*c* and the fourth fixing structure 1023*a* is a second fixing post 143, one of the second fixing structure 103*c* and the fourth fixing structure 1023*a* is a second fixing hole 144, the first fixing structure 103*b* extends along a direction D2 of a first tangent line perpendicular to the extending direction, and the second fixing structure 103*c* extends along a direction D3 of a second tangent line perpendicular to the extending direction.

In an embodiment, the first fixing post 141 includes a first post body 1411 and a first buckle hook portion 1412 connected to one end of the first post body 1411 away from the flexible connection portion 103*a*, and an outer diameter of the first buckle hook portion 1412 is greater than an outer diameter of the first post body 1411 to prevent the first fixing post 141 from detaching from the first fixing hole 142; the second fixing post 143 includes a second post body 1431 and a second buckle hook portion 1432 connected to one end of the second post body 1431 away from the flexible connection portion 103*a*, and an outer diameter of the second buckle hook portion 1432 is greater than an outer diameter of the second post body 1431 to prevent the second fixing post 143 from detaching from the second fixing hole 144.

In an embodiment, the first fixing hole 142 includes a first portion 1421 corresponding to the first post body 1411 and a second portion 1422 corresponding to the first buckle hook portion 1412, and a hole diameter of the second portion 1422 is greater than a hole diameter of the first portion 1421; the second fixing hole 144 includes a third portion 1441 corresponding to the second post body 1431 and a fourth portion 1442 corresponding to the second buckle hook portion 1432, and a hole diameter of the fourth portion 1442 is greater than a hole diameter of the third portion 1441.

In an embodiment, the connection member 103 includes at least one neck support (such as a first neck support portion 111 and a second neck support portion 112), the at least one neck support is connected to the inner side of the flexible connection portion 103*a* adjacent to the human neck, and the at least one neck support is configured to form at least one air inlet gap with the first fan portion 101 or the second fan portion 102, so that air of the first fan portion 101 or the second fan portion 102 can enter the air inlet gap (such as 121, 131). Thereby preventing the human neck from directly contacting with the first fan portion 101 or the second fan portion 102, and avoiding the situation that wind cannot be provided to a surface of the neck skin.

As shown previously, in this embodiment, the at least one neck support includes the first neck support portion 111 and the second neck support portion 112, the first neck support portion 111 is positioned adjacent to the first fan portion 101 and is configured to form a first air inlet gap 121 with the first fan portion 101, and the second neck support portion 112 is positioned adjacent to the second fan portion 102 and is configured to form a second air inlet gap 131 with the second fan portion 102.

In an embodiment, a plurality of projections 103*b* are arranged on surfaces of the first neck support portion 111 and the second neck support portion 112 away from the flexible connection portion 103*a*, and the plurality of projections 103*b* are configured to form a gap between the at least one neck support and the human neck skin. The plurality of projections 103*b* are further configured to avoid the situation that the human neck directly contacts the first fan portion 101 or the second fan portion 102, resulting in the inability to supply wind to the surface of the neck skin.

It can be seen that the surfaces of the first neck support portion 111 and the second neck support portion 112 away from the flexible connection portion 103*a* are arc-shaped. A size of the plurality of projections gradually decreases from a middle to two ends along a vertical direction D4 perpendicular to the extending direction D1. Thereby achieving a comfortable wearing effect.

In this embodiment, the flexible connection portion 103*a*, the first neck support portion 111 and the second neck support portion 112 are made of a flexible material, such as the same flexible material (such as a flexible silica gel material), and they are integrally formed. Thereby achieving a comfortable wearing effect.

Furthermore, the flexible connection portion 103*a* includes a main body portion 103*b*, a first extending portion 103*c* and a second extending portion 103*f*, the main body portion 103*d* is provided with the at least one installation hole 1031, the first extending portion 103*e* and the second extending portion 103*f* are respectively connected to each of two ends of the main body portion 103*b*, the first extending portion 103*e* and the second extending portion 103*f* protrude from the main body portion 103*b* along the extending direction D1, the first extending portion 103*c* and the second extending portion 103*f* are respectively configured to cover and connect to an inner surface of the first connection end 1013 adjacent to the human neck and an inner surface of the second connection end 1023 adjacent to the human neck. The first fixing structure and the second fixing structure are respectively arranged on the first extending portion 103*e* and the second extending portion 103*f*, thereby the first fixing structure and the second fixing structure being adjacent to an inner side of the human neck. The first anti-detachment structure and the second anti-detachment structure are positioned away from an outer side of the human neck, and the internal and external cooperation enables the connection member 103 to reliably connect the first fan portion 101 and the second fan portion 102, preventing the connection parts from easily getting detached.

In this embodiment, the first air guide chamber 2 is located inside the first fan portion 101; the first fan portion 101 is further provided with a first mounting chamber 1014; and the first power supply assembly 8 is located inside the first mounting chamber 1014. The second air guide chamber 4 is located inside the second fan portion 102; the second fan portion 102 is further provided with a second mounting chamber 1024; and the second power supply assembly 9 is located inside the second mounting chamber 1024.

In this embodiment, the first fan portion 101 is further provided with a first button switch 1015, a first charging interface 1016, and a first indicator lamp module 1017; and the first button switch 1015, the first charging interface 1016, and the first indicator lamp module 1017 are all electrically connected to the first power supply assembly 8. The second fan portion 102 is further provided with a second button switch 1025, a second charging interface 1026, and a second indicator lamp module 1027; and the second button switch 1025, the second charging interface 1026, and the second indicator lamp module 1027 are all electrically connected to the second power supply assembly 9. Through the above structure, both the first button switch 1015 and the second button switch 1025 are configured to turn on or turn off the neck fan. The first charging interface 1016 and the second charging interface 1026 are configured to charge the first battery 81 and the second battery 91, respectively. The first indicator lamp module 1017 and the second indicator lamp module 1027 can be configured to: display whether the fan is in an ON or OFF state and display a wind rating of the fan.

In this embodiment, referring to FIG. 7 to FIG. 13, the neck fan further includes a first charging control module 811, a first battery protection module 812, a first charging indicator module 813, a first main control module 814, and a first boost module 815 which are electrically connected to the first circuit board 82.

The first charging interface 1016 and the first charging control module 811 are both electrically connected to the first battery 81; the first charging indicator module 813 is connected to the first charging control module 811; the first charging interface 1016 and the first charging control module 811 are configured to charge the first battery 81; the first battery level indicator lamp module 813 is configured to display a state of charging; and the first battery protection module 812 is electrically connected to the first charging control module 811 and the first battery 81 to protect the first battery 81.

The first main control module 814, the first boost module 815, and a first motor 32 are all electrically connected to the first battery 81; the first button switch 1015 and the first indicator lamp module 1017 are electrically connected to the first main control module 814; and the first indicator lamp module 1017 is configured to display turning on or turning off of the neck fan.

In this embodiment, the neck fan further includes a second charging control module 921, a second battery protection module 922, a second charging indicator module 923, a second main control module 924, and a second boost module 925 which are electrically connected to the second circuit board 92.

The second charging interface 1026 and the second charging control module 921 are both electrically connected to the second battery 91; the second charging indicator module 913 is connected to the second charging control module 921; the second charging interface 1026 and second first charging control module 921 are configured to charge the second battery 91; the second charging indicator lamp module 923 is configured to display a state of charging; and the second battery protection module 922 is electrically connected to the second charging control module 921 and the second battery 91 to protect the second battery 91.

The second main control module 924, the first boost module 925, and a second motor 52 are all electrically connected to the second battery 91; the second button switch 1025 and the second indicator lamp module 1027 are electrically connected to the second main control module 924; and the second indicator lamp module 1027 is configured to display turning on or turning off of the neck fan.

In this embodiment, the first fan portion 101 is provided with a first conductive end 1018; the second fan portion 102 is provided with a second conductive end 1019; when the first conductive end 1018 is communicated to the second conductive end 1019, the first button switch 1015 is electrically connected to the first main control module 814 and the second main control module 924 respectively, and the second button switch 1025 is electrically connected to the first main control module 814 and the second main control module 924 respectively; and the first button switch 1015 or the second button switch 1025 is configured to send a third fan working signal.

The first main control module 814 is configured to: receive the third fan working signal and drive the first boost module 815 to receive and boost the output voltage of the first battery 81, to drive the first motor 32 to work; and the second main control module 924 is configured to: receive the third fan working signal and drive the second boost module 925 to receive and boost the output voltage of the second battery 91, to drive the second motor 52 to work.

In this embodiment, the first fan portion 101 and the second fan portion 102 can be regarded as two independent fans electrically connected to each other to form the neck fan. The circuit diagrams of various circuit modules included in the two independent fans are the same.

Through the above structure, the first fan portion 101 and the second fan portion 102 are combined and spliced to form the complete U-shaped neck fan. At this time, the first conductive end 1018 is in conductive connection with the second conductive end 1019. When the user presses the first button switch 1015 or the second button switch 1025, the third fan working signal can be sent. At this time, after receiving the third fan working signal, the first main control module 814 drives the first boost module 815 to receive and boost the output voltage of the first battery 81, thereby driving the first motor 32 to work. The rotation of the first motor 32 can drive a first fan blade 33 to rotate, achieving the air blowing effect of the first fan assembly. After receiving the third fan working signal, the second main control module 924 drives the second boost module 925 to receive and boost the output voltage of the second battery 91, thereby driving the second motor 52 to operate. The rotation of the second motor 52 can drive a second fan blade 53 to rotate, achieving the air blowing effect of the second fan assembly.

Figure 11:
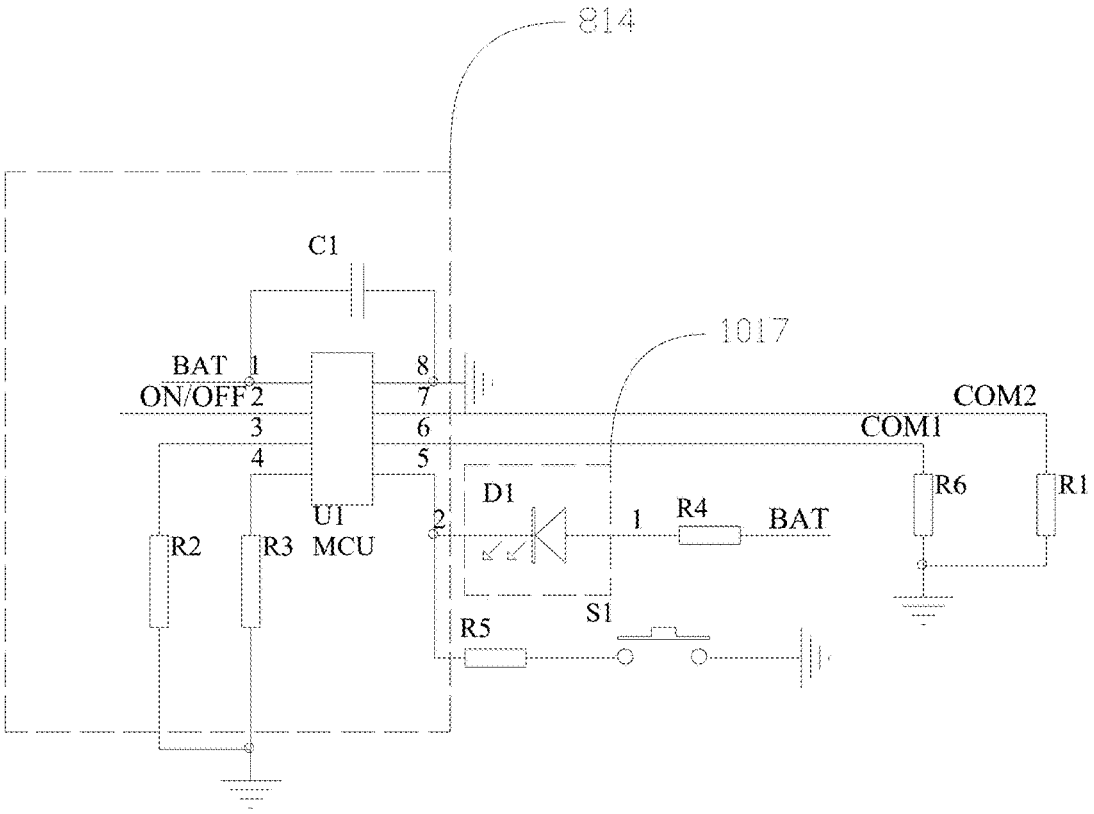
FIG. 11 is a circuit diagram of a first main control module of the neck fan of the present invention.
Figure 12:
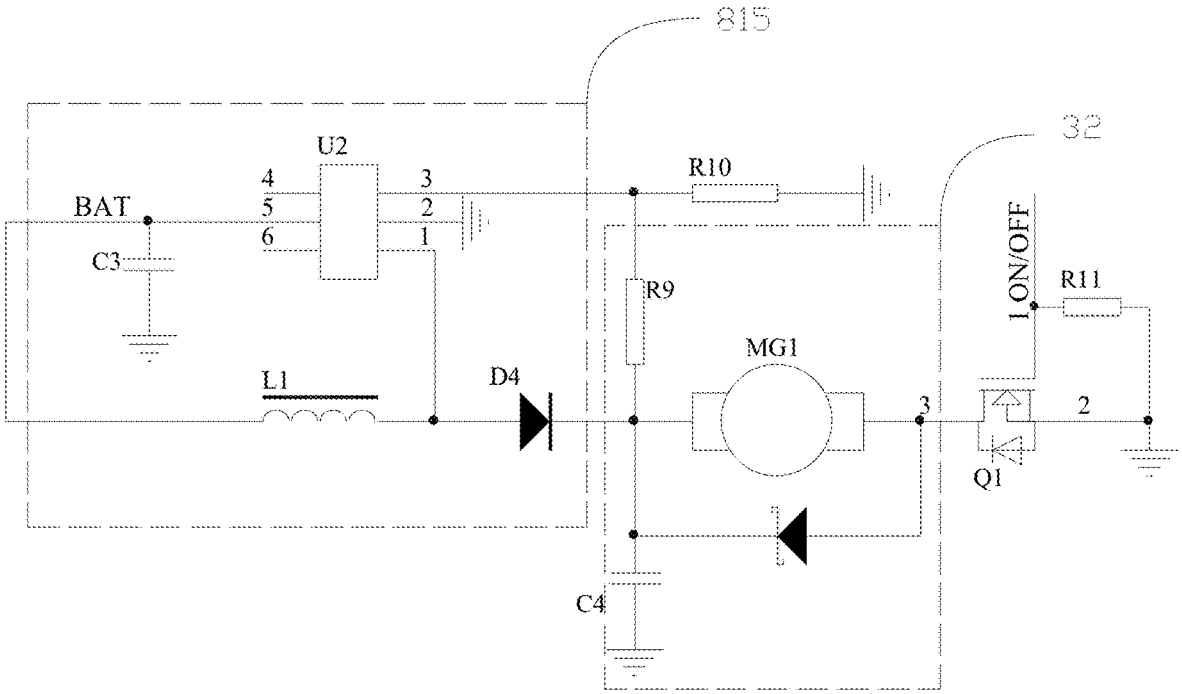
FIG. 12 is a circuit diagram of a first boost module and a first motor of the neck fan of the present invention.
Figure 13:
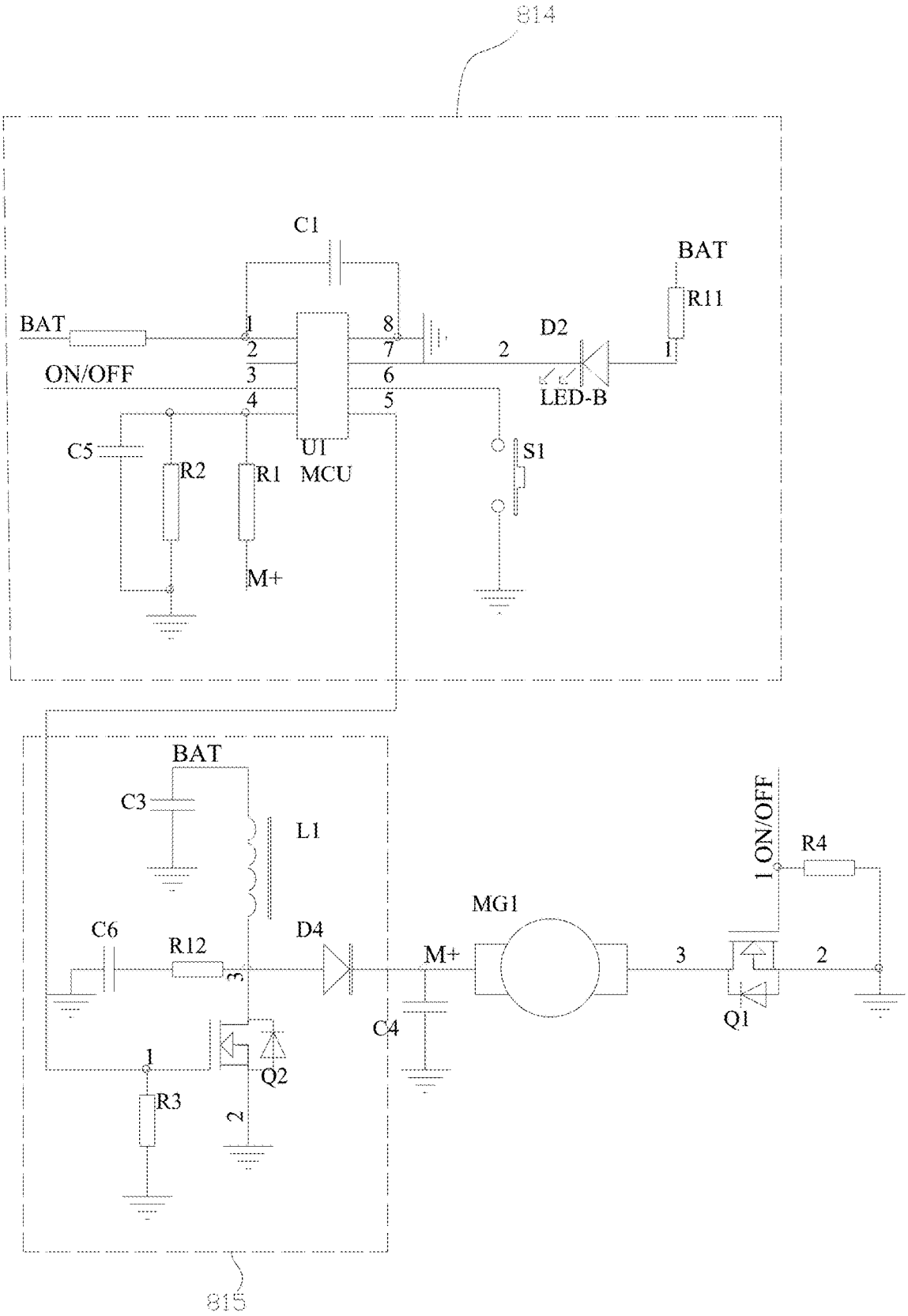
FIG. 13 is a circuit diagram of a first main control module, a first boost module and a first motor of the neck fan according to an alternative embodiment of the present invention.

It can be understood, the first main control module 814 of FIG. 11 and the first boost module 815 may have other embodiments. Referring to FIG. 12, in other embodiment, a boost control chip U2 of the first boost module 815 can be omitted. Specially, in the embodiment of FIG. 13, the first boost module 815 includes an inductor L1 and a switch element Q2, a control terminal of an MCU of the first main control module 814 is electrically connected to a control terminal of the switch element Q2, a first connection terminal of the switch element Q2 is electrically connected to the battery BAT via the first inductor L1, and a second connection terminal of the switch element Q2 is grounded. The first connection terminal of the switch element Q2 is also electrically connected to the first motor MG1, in detail, the first connection terminal of the switch element Q2 is also electrically connected to the first motor MG1 via a diode D4. The MCU of the first main control module 814 is configured to turn on/turn off the switch element Q2, such that a voltage of the battery BAT can boost, and a boosted voltage can be provided to the first motor MG1 to drive the first fan blade 33. Further, the second main control module 924 and the second boost module 925 of FIG. 5 also can have the same structure of the first boost module 815 and the first main control module 814 of FIG. 13, such that another boosted voltage can be provided to the second motor to drive the second fan blade 53.

Embodiment II

Figure 14:
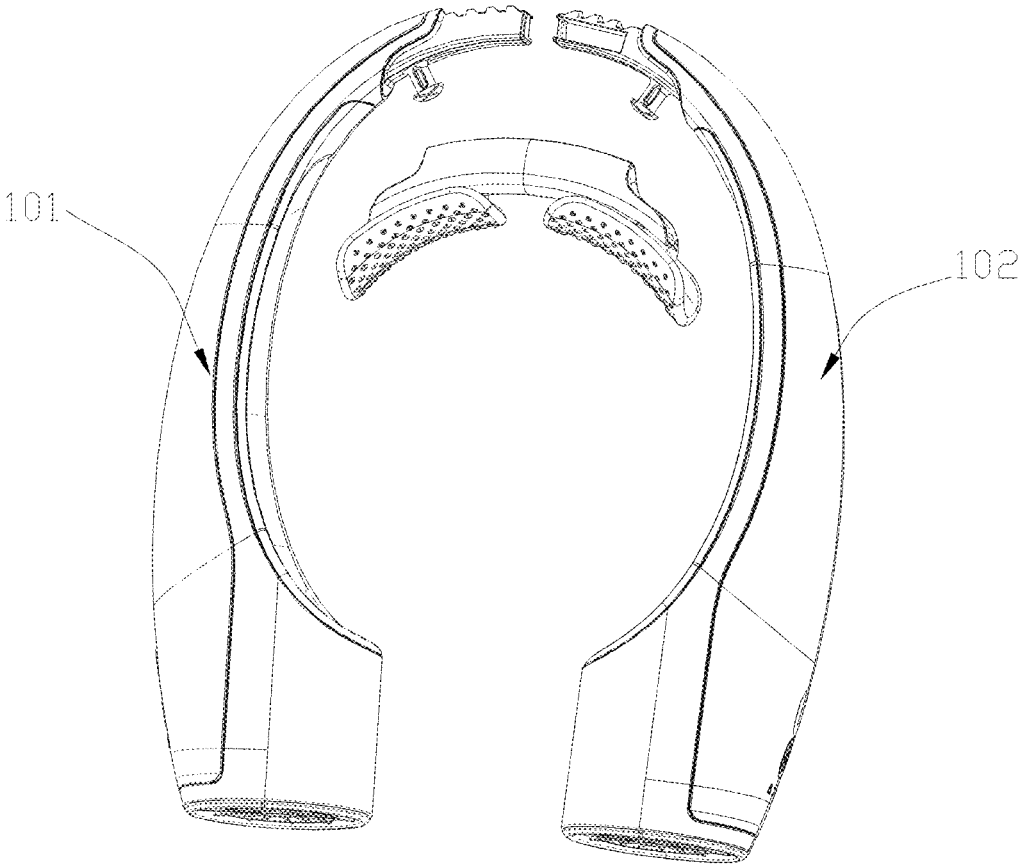
FIG. 14 is a schematic diagram of an entire structure of the neck fan according to Embodiment II of the present invention.
Figure 15:
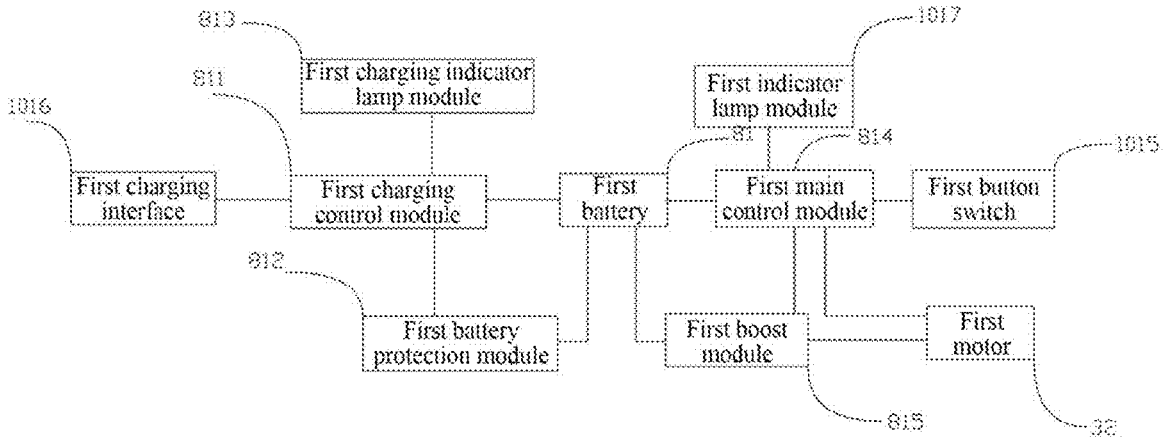
FIG. 15 is a schematic block diagram of a first fan portion of the neck fan according to Embodiment II of the present invention.
Figure 16:
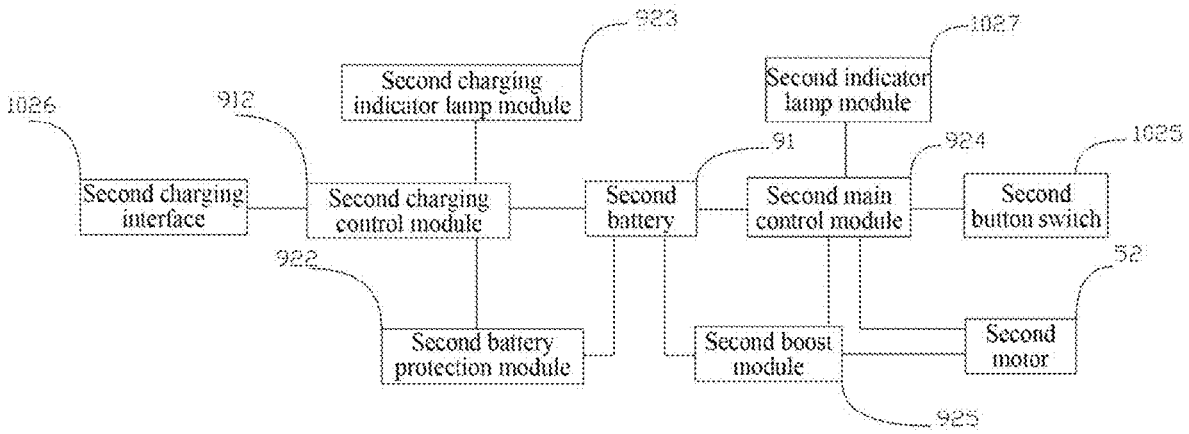
FIG. 16 is a schematic block diagram of a second fan portion of the neck fan according to Embodiment II of the present invention.
Figure 17:
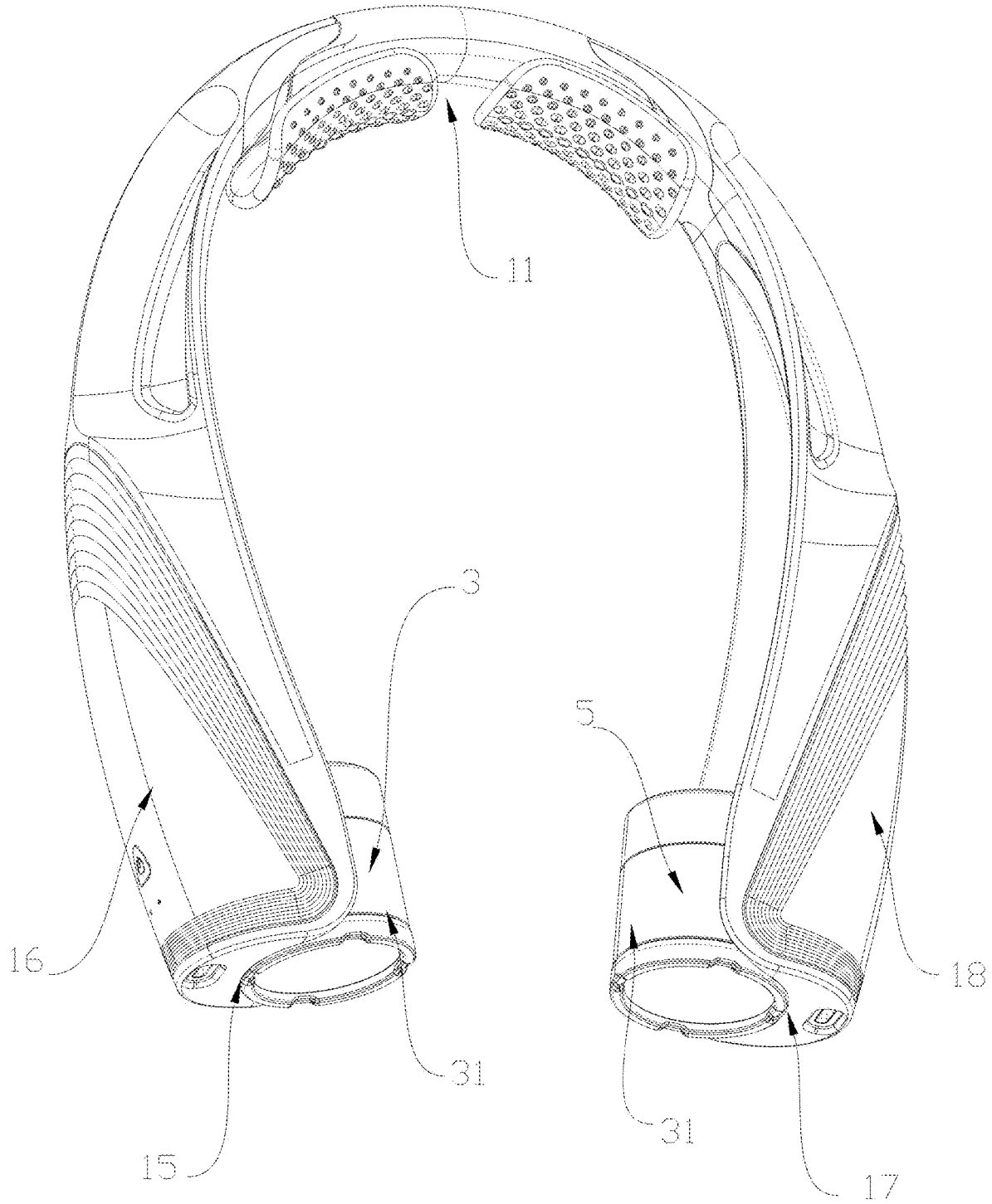
FIG. 17 is a schematic diagram of an entire structure of the neck fan according to Embodiment III of the present invention.
Figure 18:
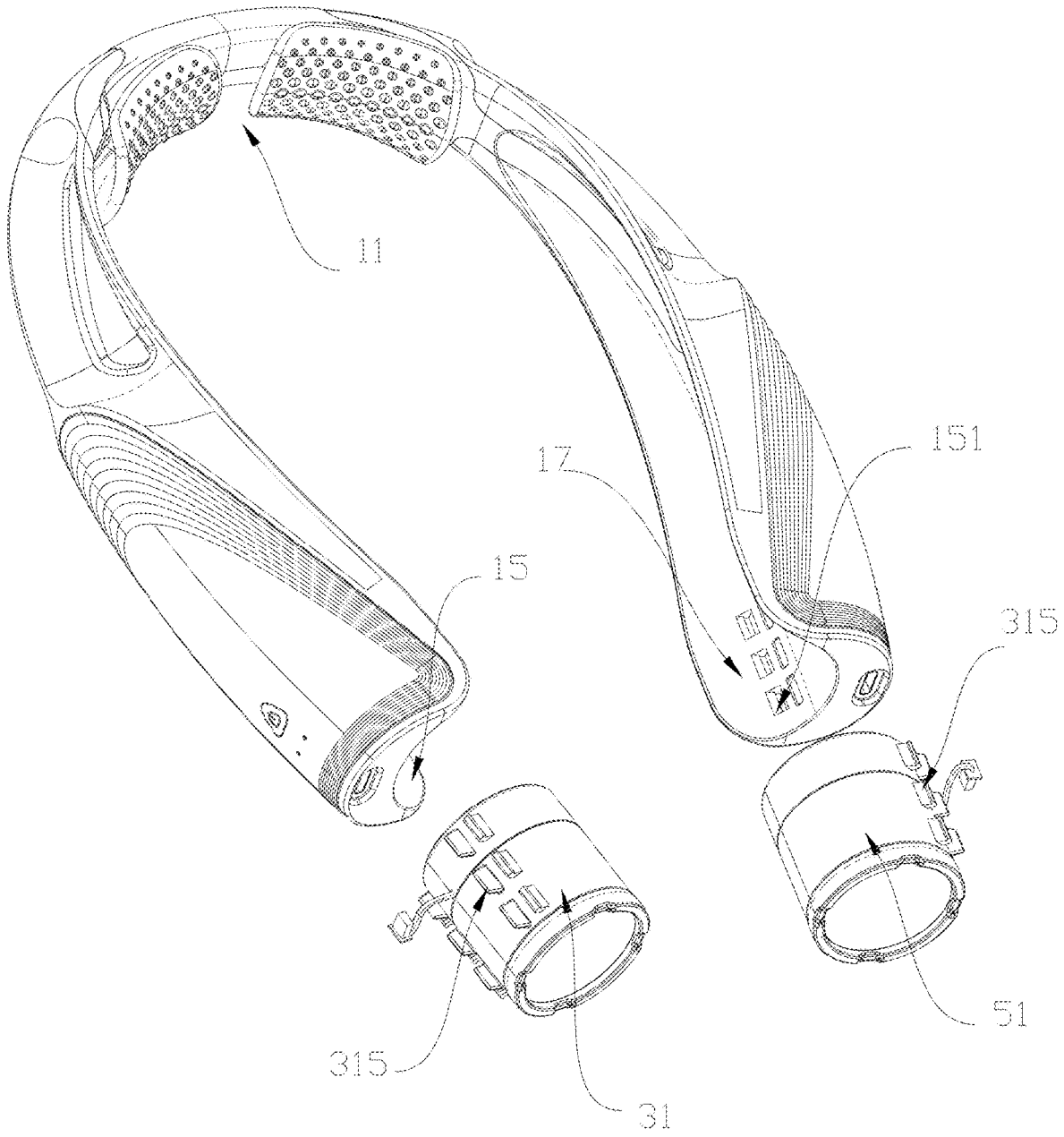
FIG. 18 is an exploded view of the neck fan according to Embodiment III of the present invention.
Figure 19:
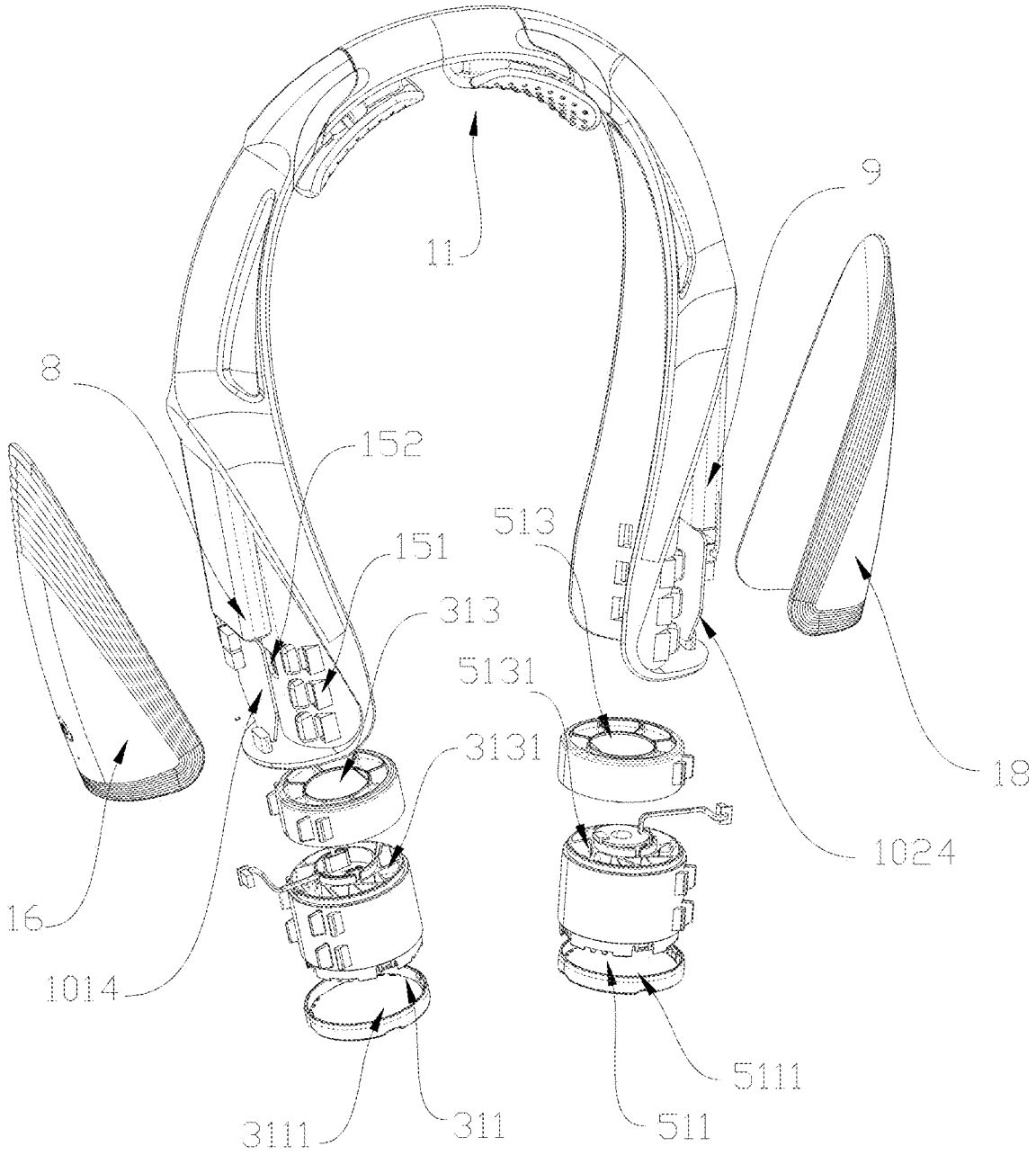
FIG. 19 is another exploded view of the neck fan according to Embodiment III of the present invention.
Figure 20:
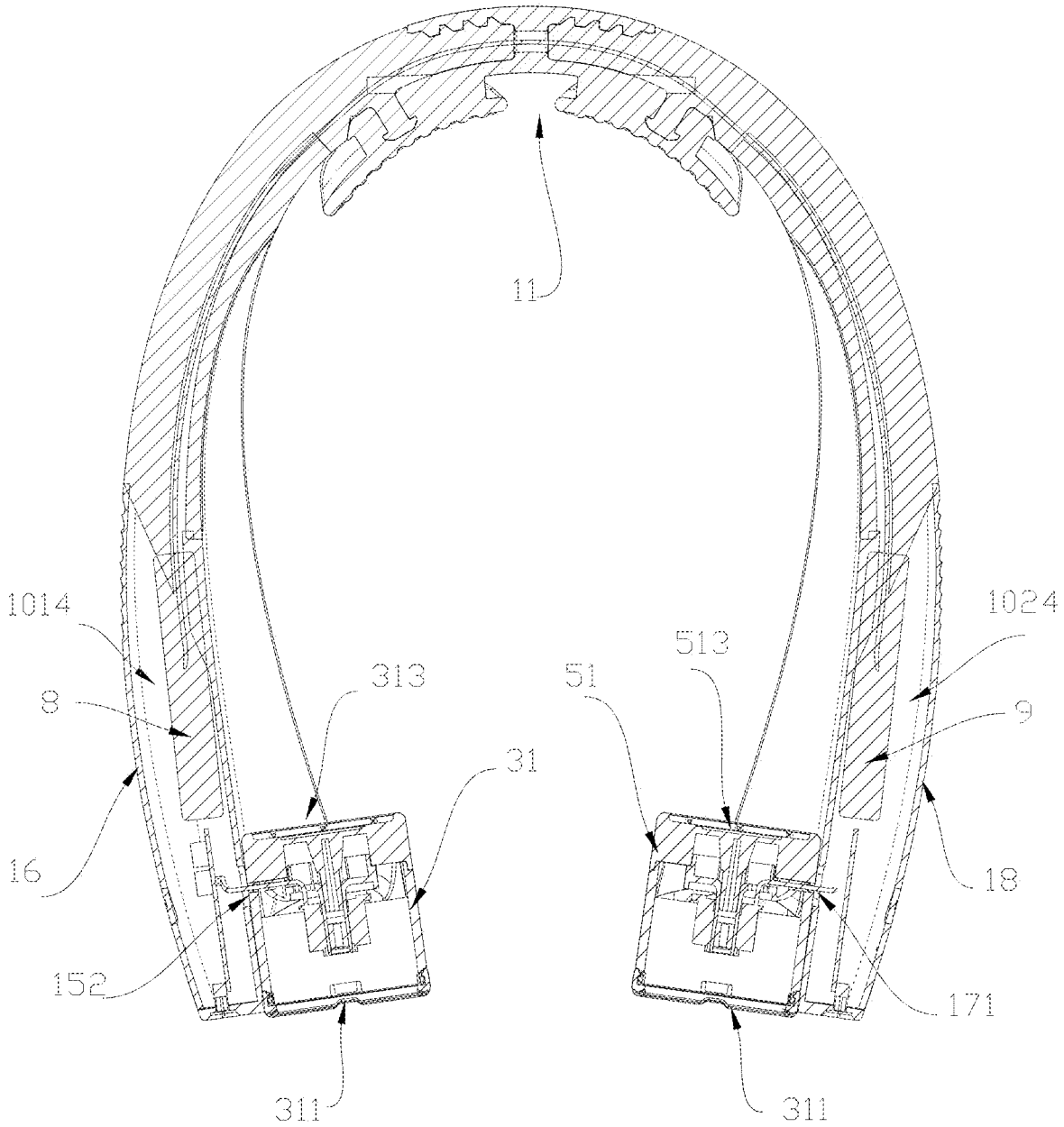
FIG. 20 is a cross-sectional view of the neck fan according to Embodiment III of the present invention.

Referring to FIG. 14 to FIG. 16, a difference between Embodiment II and Embodiment I is only that the first fan portion 101 and the second fan portion 102 of the neck fan are removed to form two independent fans, so that the first fan portion 101 and the second fan portion 102 are two small fans capable of working alone.

In this embodiment, the first fan portion 101 includes a first charging control module 811, a first battery protection module 812, a first charging indicator module 813, a first main control module 814, and a first boost module 815 which are electrically connected to the first circuit board 82.

The first charging interface 1016, the first charging control module 811, and the first charging indicator lamp module 813 are all electrically connected to the first battery 81; the first charging interface 1016 and the first charging control module 811 are configured to charge the first battery 81; the first charging indicator lamp module 813 is configured to display a battery level of the first battery 81; and the first battery protection module 812 is electrically connected to the first charging control module 811 and the first battery 81 to protect the first battery 81.

The first main control module 814, the first boost module 815, and a first motor 32 are all electrically connected to the first battery 81; the first button switch 1015 and the first indicator lamp module 1017 are electrically connected to the first main control module 814; the first button switch 1015 is configured to send a first fan working signal; the first main control module 814 is configured to: receive the first fan working signal and drive the first boost module 815 to receive and boost an output voltage of the first battery 81, to drive the first motor 32 to work; and the first indicator lamp module 1017 is configured to display turning on or turning off of the neck fan.

Through the above structure, the first charging interface 1016 is configured to charge the first battery 81; the first charging control module 811 is configured to control the charging of the first battery 81; when the first button switch 1015 is turned on, the first fan working signal is sent; when receiving the first fan working signal, the first main control module 814 is configured to drive the first boost module 815 to receive and boost the output voltage of the first battery 81, to drive the first motor 32 to work; and the first main control module 814 can further adjust the speed of the first motor 32 by controlling the output voltage of the first boost module 815.

In this embodiment, the second fan portion 102 includes a second charging control module 921, a second battery protection module 922, a second charging indicator module 923, a second main control module 924, and a second boost module 925 which are electrically connected to the second circuit board 92.

The second charging interface 1026, the second charging control module 921, and the second charging indicator lamp module 923 are all electrically connected to the second battery 91; the second charging interface 1026 and the second charging control module 921 are configured to charge the second battery 91; the first charging indicator lamp module 923 is configured to display a battery level of the second battery 91; and the second battery protection module 922 is electrically connected to the second charging control module 921 and the second battery 91 to protect the second battery 91.

The second main control module 924, the second boost module 925, and a second motor 52 are all electrically connected to the second battery 91; the second button switch 1025 and the second indicator lamp module 1027 are electrically connected to the second main control module 924; the second button switch 1025 is configured to send a second fan working signal; the second main control module 924 is configured to: receive the second fan working signal and drive the second boost module 925 to receive and boost an output voltage of the second battery 91, to drive the second motor 52 to work; and the second indicator lamp module 1027 is configured to display turning on or turning off of the neck fan.

Through the above structure, the second charging interface 1026 is configured to charge the second battery 91; the second charging control module 921 is configured to control the charging of the second battery 91; when the second button switch 1025 is turned on, the second fan working signal is sent; when receiving the second fan working signal, the second main control module 924 is configured to drive the second boost module 925 to receive and boost the output voltage of the second battery 91, to drive the second motor 52 to work; and the second main control module 924 can further adjust the speed of the second motor 52 by controlling the output voltage of the second boost module 925. This structural design achieves an effect of using independent portions as independent fans after the neck fan is disassembled, bringing higher flexibility, and a user can select an appropriate usage method according to a specific need.

Embodiment III

Referring to FIG. 17 to FIG. 20, the neck fan includes a hanging main body 1, wherein the hanging main body 1 includes an inner end portion 11 that is in contact with the neck of a user; a first accommodating chamber 15 is inwards sunken in one side, close to an inner end portion, of a lower end portion of the hanging main body 1; and a first fan assembly 3, wherein the first fan assembly 3 includes a straight-tube-shaped first fan shell 31. The first fan shell 31 is detachably connected to the hanging main body 1 and is located in the first accommodating chamber 15; the first fan shell 31 is provided with a third air inlet 311 and a third air outlet 313; and the first fan assembly 3 is configured to drive an air flow to be blown from the third air inlet 311 towards the inner end portion 11 via the third air outlet 313.

Through the above structure, due to the straight-tube shape of the first fan shell 31, the neck fan is formed into a vertical blowing type fan capable of blowing air in a vertical direction. The first fan assembly 3 can drive the air flow to be blown from the third air inlet towards the inner end portion 11 via the third air outlet, greatly improving the air blowing efficiency. A user can directly feel the cool air blown directly to the neck when using the neck fan, thereby improving the overall performance of the fan. Furthermore, the first fan shell is detachably connected and assembled with the hanging main body, so that separate mold opening, machining, and assembling can be achieved during production. The production efficiency is improved; the production cost is reduced; it is also convenient for storage and transportation; and the portability of the product is improved.

In this embodiment, several connection buckle slots 151 are provided in an inner side of the hanging main body 1 close to the first accommodating chamber 15; several connection buckles 315 matched and clamped with the connection buckle slots 151 are arranged on an outer wall of the first fan shell 31; and the first fan shell 31 is in detachably buckled connection to the hanging main body 1. Specifically, the connection buckle slots 151 are symmetrically distributed on an inner side of the hanging main body 1. There are six groups of connection buckle slots 151. Each group includes two connection buckle slots 151. The connection buckles 315 are symmetrically located on the outer wall of the first fan shell 31. There are six groups of connection buckles 315, and each group includes two connection buckles 315. Through the above structure, a user can manually mount or remove the first fan shell onto or from the hanging main body. The six groups of buckle matching structures ensure the firmness of splicing, prevent the first fan shell from being separated during wearing and use, and improve the safety and convenience of the neck fan.

In this embodiment, the hanging main body 1 is detachably connected with a first outer cover 16 on an outer side away from the first accommodating chamber 15. As in Embodiment I, the first fan portion 101 of the hanging main body is provided with a first mounting chamber 1014, and the first power supply assembly 8 is located inside the first mounting chamber 1014. The first mounting chamber 1014 has an opening, and the first outer cover 16 is detachably covered at the opening.

In this embodiment, the first fan assembly 3 further includes a first motor 32 and a first fan blade 33 mounted on a rotating shaft of the first motor 32. A first barrier net 3111 is connected to the third air inlet 311. A first air gathering ring 3131 is connected to the third air outlet 313. The first barrier net 3111 can prevent hairs or debris from being sucked into the first fan shell, thereby avoiding damage to the fan assembly and reducing the wind force of blowing of the fan. The first air gathering ring 3131 can gather the air blown towards the neck, thereby improving the blowing performance.

In this embodiment, a first conductive through hole 152 is provided in an inner side of the hanging main body close the first accommodating chamber 15. The first conductive through hole 152 is configured to allow a wire of the first fan assembly 3 to pass through to be communicated to the first power supply assembly 8.

Through the above structure, when the neck fan needs to be assembled, the first outer cover 16 is first opened, and then the wire of the first fan assembly 3 is communicated to the first power supply assembly 8 in the first mounting chamber 1014 through the first conductive through hole 152. Then, the first outer cover 16 is closed. After the wire of the first fan assembly 3 is connected, the first fan shell is assembled with the hanging main body through the buckling between the connection buckles 315 and the connecting buckle slots 151, and finally a vertical blowing type neck fan that is conductive with the hanging main body and easy to mount is obtained.

In this embodiment, a second accommodating chamber 17 is further inwards sunken in one side, opposite to the first accommodating chamber 15, of the lower end portion of the hanging main body. The neck fan further includes a second fan assembly 5. The second fan assembly 5 includes a straight-tube-shaped second fan shell. The second fan shell is detachably connected to the hanging main body and is located in the second accommodating chamber 17. The second fan shell is provided with a fourth air inlet 511 and a fourth air outlet 513. The first fan assembly 5 is configured to drive an air flow to be blown from the fourth air inlet 511 towards the inner end portion via the fourth air outlet 513. Through the above structure, similarly, due to the straight-tube shape of the second fan shell 51, the neck fan is formed into a vertical blowing type fan capable of blowing air in a vertical direction. The second fan assembly can drive the air flow to be blown from the fourth air inlet 511 towards the inner end portion 11 via the fourth air outlet 513, greatly improving the air blowing efficiency. A user can directly feel the cool air blown directly to the neck when using the neck fan, thereby improving the overall performance of the fan. Furthermore, the second fan shell 51 is detachably connected and assembled with the hanging main body 1, so that separate mold opening, machining, and assembling can be achieved during production. The production efficiency is improved; the production cost is reduced; it is also convenient for storage and transportation; and the portability of the product is improved.

In this embodiment, several connection buckle slots 151 are provided in an inner side of the hanging main body close to the second accommodating chamber 17; several connection buckles 315 matched and clamped with the connection buckle slots 151 are arranged on an outer wall of the second fan shell 51; and the second fan shell 51 is in detachably buckled connection to the hanging main body 1. Specifically, the connection buckle slots 151 are symmetrically distributed on an inner side of the hanging main body. There are six groups of connection buckle slots 151. Each group includes two connection buckle slots 151. The connection buckles 315 are symmetrically located on the outer wall of the second fan shell. There are six groups of connection buckles 315, and each group includes two connection buckles 315.

In this embodiment, the hanging main body is detachably connected with a second outer cover 18 on an outer side away from the second accommodating chamber 17. As in Embodiment I, the second fan portion 102 of the hanging main body 1 is provided with a second mounting chamber 1024, and the second power supply assembly 9 is located inside the second mounting chamber 1024. The second mounting chamber 1024 has an opening, and the second outer cover 18 is detachably covered at the opening.

Further, the second fan assembly 5 further includes a second motor 52 and a second fan blade 53 mounted on a rotating shaft of the second motor. A second barrier net 5111 is connected to the fourth air inlet 511. A second air gathering ring 5131 is connected to the fourth air outlet 513.

In this embodiment, a second conductive through hole 171 is provided in an inner side of the hanging main body close the second accommodating chamber 17. The second conductive through hole 171 is configured to allow a wire of the second fan assembly 5 to pass through to be communicated to the second power supply assembly 9.

Through the above structure, after the assembling of the first fan shell 31 is completed, the second fan shell 51 is mounted in the same way. The second outer cover 18 is first opened, and then the wire of the second fan assembly 5 is communicated to the second power supply assembly 9 in the second mounting chamber 1024 through the second conductive through hole 171. Then, the second outer cover 18 is closed. After the wire of the second fan assembly 5 is connected, the second fan shell 51 is assembled with the hanging main body 1 through the buckling between the connection buckles 315 and the connecting buckle slots 151, and finally a vertical blowing type neck fan that is conductive with the hanging main body 1 and easy to mount is obtained.

In this embodiment, all other structures and functions are the same as those in Embodiment I.

One or more implementation modes are provided above in combination with specific contents, and it is not deemed that the specific implementation of the present invention is limited to these specifications. Any technical deductions or replacements approximate or similar to the method and structure of the present invention or made under the concept of the present invention shall fall within the scope of protection of the present invention.

What is claimed is:

1. A connection member of a neck fan, configured to connect to a first fan portion and a second fan portion arranged opposite each other, wherein the connection member comprises a flexible connection portion, the flexible connection portion is provided with at least one installation hole, the at least one installation hole is configured to extend along an extending direction from a first connection end of the first fan portion to a second connection end of the second fan portion, and the at least one installation hole is further configured to be sleeved and fixed onto the first connection end and the second connection end, so that the first fan portion and the second fan portion are connected through the flexible connection portion;

wherein the flexible connection portion is made of a silica gel material; and wherein an inner sidewall of the at least one installation hole is provided with a first anti-detachment structure and a second anti-detachment structure, the first anti-detachment structure is configured to be snap-fitted and connected to a first buckle on an outer surface of the first connection end, the second anti-detachment structure is configured to be snap-fitted and connected to a second buckle on an outer surface of the second connection end, and at least one of the first anti-detachment structure and the first buckle comprises a plurality of convex-concave structures arranged in sequence along the extending direction.

2. The connection member of a neck fan according to claim 1, wherein the at least one installation hole is an installation through hole arranged along the extending direction, and each of two ends of the installation hole is respectively configured to sleeve and fix the first connection end and the second connection end.

3. The connection member of a neck fan according to claim 1, wherein the first anti-detachment structure comprises a plurality of first buckle slots arranged along the extending direction, the first buckle slot is configured to be meshed and connected to a plurality of projections arranged along the extending direction on the first buckle, the second anti-detachment structure comprises a plurality of second buckle slots arranged along the extending direction, the second buckle slot is configured to be meshed and connected to a plurality of projections arranged along the extending direction on the second buckle, the first anti-detachment structure is configured to be detachably connected to the first buckle, and the second anti-detachment structure is configured to be detachably connected to the second buckle.

4. The connection member of a neck fan according to claim 1, wherein the flexible connection portion is arc-shaped and provided with an inner side adjacent to a human neck and an outer side away from the human neck, the first anti-detachment structure is arranged on an inner sidewall of one side of the at least one installation hole adjacent to the outer side, and the second anti-detachment structure is arranged on an inner sidewall of the other side of the at least one installation hole adjacent to the outer side.

5. The connection member of a neck fan according to claim 1, wherein the flexible connection portion is provided with a first fixing structure and a second fixing structure, the first fixing structure and the second fixing structure are respectively arranged on each of two ends of the flexible connection portion, the first fixing structure is configured to connect to a third fixing structure of the first connection end, the second fixing structure is configured to connect to a fourth fixing structure of the second connection end, the first fixing structure is configured to detachably connect to the third fixing structure, and the second fixing structure is configured to detachably connect to the fourth fixing structure.

6. The connection member of a neck fan according to claim 5, wherein one of the first fixing structure and the third fixing structure is a first fixing post, one of the first fixing structure and the third fixing structure is a first fixing hole, one of the second fixing structure and the fourth fixing structure is a second fixing post, one of the second fixing structure and the fourth fixing structure is a second fixing hole, the first fixing structure extends along a direction of a first tangent line perpendicular to the extending direction, and the second fixing structure extends along a direction of a second tangent line perpendicular to the extending direction.

7. The connection member of a neck fan according to claim 6, wherein the first fixing post comprises a first post body and a first buckle hook portion connected to one end of the first post body away from the flexible connection portion, and an outer diameter of the first buckle hook portion is greater than an outer diameter of the first post body to prevent the first fixing post from detaching from the first fixing hole; the second fixing post comprises a second post body and a second buckle hook portion connected to one end of the second post body away from the flexible connection portion, and an outer diameter of the second buckle hook portion is greater than an outer diameter of the second post body to prevent the second fixing post from detaching from the second fixing hole.

8. The connection member of a neck fan according to claim 7, wherein the first fixing hole comprises a first portion corresponding to the first post body and a second portion corresponding to the first buckle hook portion, and a hole diameter of the second portion is greater than a hole diameter of the first portion; the second fixing hole comprises a third portion corresponding to the second post body and a fourth portion corresponding to the second buckle hook portion, and a hole diameter of the fourth portion is greater than a hole diameter of the third portion.

9. The connection member of a neck fan according to claim 1, wherein the connection member comprises at least one neck support, the at least one neck support is connected to the inner side of the flexible connection portion adjacent to the human neck, and the at least one neck support is configured to form at least one air inlet gap with the first fan portion or the second fan portion, so that air of the first fan portion or the second fan portion can enter the air inlet gap.

10. The connection member of a neck fan according to claim 9, wherein the at least one neck support comprises a first neck support portion and a second neck support portion, the first neck support portion is positioned adjacent to the first fan portion and is configured to form a first air inlet gap with the first fan portion, and the second neck support portion is positioned adjacent to the second fan portion and is configured to form a second air inlet gap with the second fan portion.

11. The connection member of a neck fan according to claim 9, wherein a plurality of projections are arranged on a surface of the at least one neck support away from the flexible connection portion, and the plurality of projections are configured to form a gap between the at least one neck support and the human neck skin.

12. The connection member of a neck fan according to claim 11, wherein the surface of the at least one neck support away from the flexible connection portion is an arc-shaped.

13. The connection member of a neck fan according to claim 11, wherein a size of the plurality of projections gradually decreases from a middle to two ends along a vertical direction perpendicular to the extending direction.

14. The connection member of a neck fan according to claim 9, wherein the flexible connection portion and the at least one neck support are made of the same flexible material and are integrally formed, and the at least one neck support is made of a silica gel material.

15. The connection member of a neck fan according to claim 1, wherein the flexible connection member is configured to be detachably connected to at least one of the first connection end and the second connection end.

16. The connection member of a neck fan according to claim 1, wherein the flexible connection portion comprises a main body portion, a first extending portion and a second extending portion, the main body portion is provided with the at least one installation hole, the first extending portion and the second extending portion are respectively connected to each of two ends of the main body portion, the first extending portion and the second extending portion protrude from the main body portion along the extending direction, the first extending portion and the second extending portion are respectively configured to cover and connect to an inner surface of the first connection end adjacent to a human neck and an inner surface of the second connection end adjacent to the human neck.

17. A neck fan, wherein the neck fan comprises the connection member according to claim 1, the connection member comprises an inner end portion configured to contact with a human neck; the first fan portion and the second fan portion respectively comprise a fan assembly and a straight-tube-shaped fan shell covering an outer side of the fan assembly, the fan shell is positioned a lower end portion of a hanging main body, the fan shell is provided with an air inlet and an air outlet, and the fan assembly is configured to drive an air flow to be blown directly from the air inlet towards the inner end portion via the air outlet.

18. The neck fan according to claim 17, wherein the first fan portion and the second fan portion are provided with a first air guide path that is inwards sunken on one side adjacent to the human neck, the first air guide path extends from the first air outlet to the inner end portion, and the fan assembly drives the air flow to be blown out from the first air outlet towards the inner end portion along the first air guide path.

19. A connection member of a neck fan, configured to connect to a first fan portion and a second fan portion arranged opposite each other, wherein the connection member comprises a flexible connection portion, the flexible connection portion is provided with at least one installation hole, the at least one installation hole is configured to extend along an extending direction from a first connection end of the first fan portion to a second connection end of the second fan portion, and the at least one installation hole is further configured to be sleeved and fixed onto the first connection end and the second connection end, so that the first fan portion and the second fan portion are connected through the flexible connection portion;

wherein the first fan portion comprises a first air guide path, and the second fan portion comprises a second air guide path, the first air guide path and the second air guide path each are cutout to form an inwards sunken configuration; and wherein the connection member further comprises two neck supports, the two neck supports are connected to the inner side of the flexible connection portion adjacent to the human neck, the flexible connection portion and the at least one neck support are made of a silica gel material, and the two neck supports form a first gap with the first fan portion and a second gap with the second fan portion.

* * * * *